US005297395A

United States Patent [19]

Ozu et al.

[11] Patent Number: 5,297,395

[45] Date of Patent: Mar. 29, 1994

[54] AIR CONDITIONER USING ROTARY-TYPE HEAT EXCHANGERS

[75] Inventors: Masao Ozu, Yokohama; Masao Isshiki, Fuji; Eiji Kuwahara, Fuji; Takao Hoshi, Fuji; Atsuyuki Hiruma, Fuji; Tohru Kubo, Fuji; Atsushi Nagasawa, Mishima; Nobuo Kawai, Fujinomiya; Yoshiaki Nagaoka, Fuji; Kazuhiko Akiyama, Fuji, all of Japan

[73] Assignee: Kabushiki Kaisha Toshiba, Kawasaki, Japan

[21] Appl. No.: 11,222

[22] Filed: Jan. 29, 1993

[30] Foreign Application Priority Data

Feb. 24, 1992 [JP] Japan ..... 4-036726

[51] Int. Cl.[5] ..... F25B 41/00

[52] U.S. Cl. ..... 62/174; 62/498; 165/86; 165/121

[58] Field of Search ..... 165/86, 121, 92; 62/498, 174, 222, 228.3

[56] References Cited

U.S. PATENT DOCUMENTS 3,696,634 10/1972 Ludin et al ..... 165/92 X
4,986,345 1/1991 Uemura et al. ..... 165/86
5,140,827 8/1992 Reedy ..... 62/174

FOREIGN PATENT DOCUMENTS 59-25947 6/1984 Japan .

*Primary Examiner*—William E. Wayner
*Attorney, Agent, or Firm*—Cushman, Darby & Cushman

[57] ABSTRACT

A refrigeration cycle has a compressor, an outdoor rotary-type heat exchanger, a motor-operated expansion valve, and an indoor rotary-type heat exchanger which are sequentially connected to each other to circulate a refrigerant. A tank is set in a connected state or a non-connected state with respect to a refrigerant discharge side of the compressor. A detector detects at least a pressure at one side of each of the exchangers. A first controller sets the tank in a non-connected state when a normal operation of an air conditioner is to be started, and controls the capacity of the compressor, the rotational speed of the exchangers, and the opening degree of the valve in accordance with an air-conditioning load, thereby performing the normal operation of the air conditioner. A second controller causes the compressor to keep operating at a predetermined capacity until a detection pressure from the detector coincides with a preset value, when the air conditioner is to be stopped, and sets the tank in a connected state while controlling the valve to a predetermined opening degree, thereby recovering a refrigerant in the tank. A third controller rotates the exchangers at a predetermined speed when the air conditioner is to be started, and sets the tank in a connected state while controlling the valve to a predetermined opening degree, thereby filling the refrigerant in the exchangers from the tank.

20 Claims, 21 Drawing Sheets

AIR CONDITIONER USING ROTARY-TYPE HEAT EXCHANGERS

BACKGROUND OF THE INVENTION

1. Field of the Invention

The present invention generally relates to an air conditioner and, more particularly, to an air conditioner having rotary-type heat exchangers as indoor and outdoor heat exchangers of a refrigeration cycle.

2. Description of the Related Art

As a device for forming a refrigeration cycle in an air conditioner, a device having a rotary-type heat exchanger is available.

This rotary-type heat exchanger has both the function of a heat exchanger and the function of a fan. The rotary-type heat exchanger is designed to perform heat exchange between air and a refrigerant while taking in and blowing air by its own rotation.

The rotary-type heat exchanger is more advantageous in saving a space than a conventional finned tube type heat exchanger. If, for example, the rotary-type heat exchanger is used as an indoor heat exchanger, a reduction in the size of an indoor unit can be achieved. If it is used as an outdoor heat exchanger, a reduction in the size of an outdoor unit can be achieved.

In an air conditioner using a rotary-type heat exchanger to form a refrigeration cycle, however, a liquid refrigerant collects in a bottom portion of the rotary-type heat exchanger during a non-operation period. At the start of the next operation, therefore, the center of gravity of the rotary-type heat exchanger is shifted to cause unbalanced vibration. This unbalanced vibration adversely affects the service life of the rotary-type heat exchanger.

In an air conditioner of this type, if the seal structure of a rotary-type heat exchanger does not have a sufficient sealing effect with respect to a refrigerant, the refrigerant may leak outside during a non-operation period. In such a case, the circulation amount of a refrigeration cycle becomes insufficient, causing difficulty in performing a proper air-conditioning operation and adversely affecting the service life of a refrigeration cycle unit such as a compressor.

SUMMARY OF THE INVENTION

It is, therefore, an object of the present invention to provide a new and improved air conditioner using rotary-type heat exchangers, which can eliminate unbalanced vibration of each rotary-type heat exchanger during an operation period, and can prevent leakage of a refrigerant from each rotary-type heat exchanger, thereby contributing an improvement in reliability.

According to a first aspect of the present invention, there is provided an air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

a refrigerant tank selectively set in a connected state and a non-connected state with respect to a refrigerant discharge side of the compressor;

pressure detecting means for detecting at least a pressure at one side of each of the indoor and outdoor rotary-type heat exchangers;

first control means for setting the refrigerant tank in a non-connected state when a normal operation of the air conditioner is to be started, and controlling a capacity of the compressor, a rotational speed of the outdoor rotary-type heat exchanger, a rotational speed of the indoor rotary-type heat exchanger, and an opening degree of the motor-operated expansion valve in accordance with at least an air-conditioning load, thereby performing the normal operation of the air conditioner;

second control means for causing the compressor to keep operating at a predetermined capacity until a detection pressure from the pressure detecting means coincides with a set pressure value, when the air conditioner is to be stopped, and setting the refrigerant tank in a connected state while controlling the motor-operated expansion valve to a predetermined opening degree, thereby recovering the refrigerant in the refrigerant tank; and third control means for rotating the outdoor and indoor rotary-type heat exchangers at a predetermined speed when the air conditioner is to be started, and setting the refrigerant tank in a connected state while controlling the motor-operated expansion valve to a predetermined opening degree, thereby filling the refrigerant, recovered in the refrigerant tank by the second control means, in the outdoor and indoor rotary-type heat exchangers.

According to a second aspect of the present invention, there is provided an air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

a refrigerant tank selectively set in a connected state and a non-connected state with respect to a refrigerant discharge side of said compressor;

pressure detecting means for detecting at least a pressure at one side of each of said indoor and outdoor rotary-type heat exchangers;

first control means for setting said refrigerant tank in a non-connected state when a normal operation of said air conditioner is to be started, and controlling a capacity of said compressor, a rotational speed of said outdoor rotary-type heat exchanger, a rotational speed of said indoor rotary-type heat exchanger, and an opening degree of said motor-operated expansion valve in accordance with an air-conditioning load, thereby performing the normal operation of said air conditioner; and second control means for causing said compressor to keep operating at a predetermined capacity until a detection pressure from said pressure detecting means coincides with a set pressure value, when said air conditioner is to be stopped, and setting said refrigerant tank in a connected state while controlling said motor-operated expansion valve to a predetermined opening degree, thereby recovering the refrigerant in said refrigerant tank.

According to a third aspect of the present invention, there is provided an air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

first control means for controlling a capacity of said compressor in accordance with an air-conditioning load;

second control means for controlling a rotational speed of said outdoor rotary-type heat exchanger;

third control means for controlling a rotational speed of said indoor rotary-type heat exchanger; and fourth control means for controlling an opening degree of said motor-operated expansion valve in accordance with a state of said refrigeration cycle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
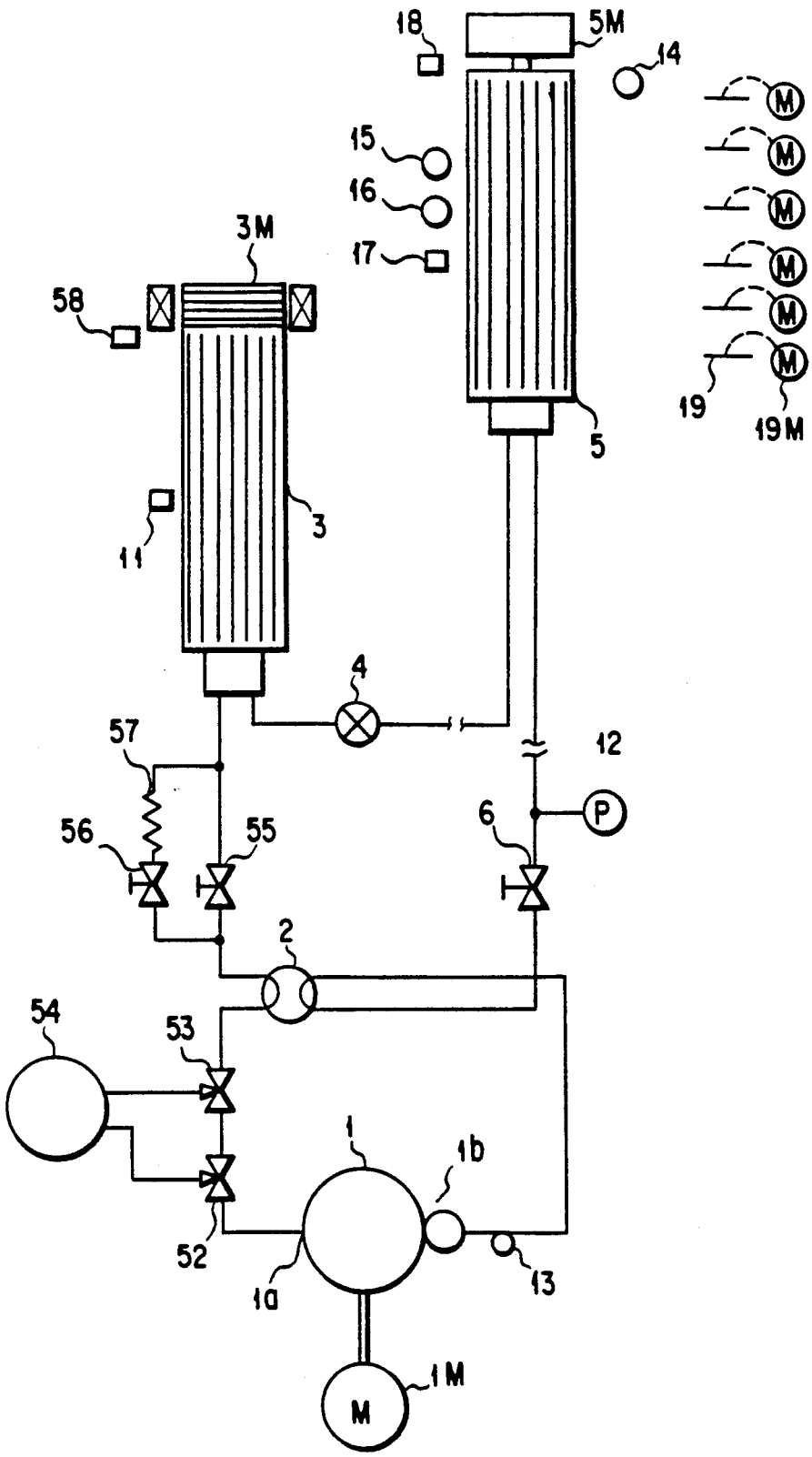
FIG. 1 is a view showing the arrangement of a refrigeration cycle used in an air conditioner according to the first embodiment of the present invention.

Reference will now be made in detail to the presently preferred embodiments of the invention as illustrated in the accompanying drawings, in which like reference characters designate like or corresponding parts throughout the several drawings.

An air conditioner according to an embodiment of the present invention will be described below with reference to the accompanying drawings.

A refrigeration cycle will be described first. As shown in FIG. 1, one end of an outdoor rotary-type heat exchanger 3 is connected to a discharge pipe connected to a discharge port 1*a* of a compressor 1 through a 4-way solenoid valve 2.

One channel (to be referred to as a line side hereinafter) of each of 3-way solenoid valves 52 and 53 is inserted/connected in/to a discharge pipe arranged between the compressor 1, which is driven by a compressor motor 1M, and the 4-way valve 2. A refrigerant tank 54 is connected to the other channel (to be referred to as a tank side hereinafter) of each of these 3-way valves 52 and 53. That is, when the line sides of the 3-way valves 52 and 53 are open, a bypath to the tank 54 is formed, whereas when the tank sides of the 3-way valves 52 and 53 are open, the tank 54 communicates with the discharge pipe.

A 2-way solenoid valve 55 is inserted/connected in/to a pipe extending from the 4-way valve 2 to the outdoor rotary-type heat exchanger 3. A series circuit of a 2-way solenoid valve 56 and a capillary tube 57 is connected in parallel with the 2-way valve 55.

One end of an indoor rotary-type heat exchanger 5 is connected to the other end of the outdoor rotary-type heat exchanger 3 through a motor operated expansion vale 4 serving as a decompressor. The other end of the indoor rotary-type heat exchanger 5 is connected to a suction port 1*b* of the compressor 1 through a 2-way solenoid valve 6 and the 4-way valve 2.

Referring to FIG. 1, a heat pump type refrigeration cycle is formed. In the cooling mode, the 4-way valve 2 is inactivated to form a cooling cycle, in which the refrigerant flows from the outdoor rotary-type heat exchanger 3 to the indoor rotary-type heat exchanger 5. In this mode, the outdoor and indoor rotary-type heat exchangers 3 and 5 serve as a condenser and an evaporator, respectively. In the heating mode, the 4-way valve 2 is activated to form a heating cycle, in which the refrigerant flows from the indoor rotary-type heat exchanger 5 to the outdoor rotary-type heat exchanger 3. In this mode, the indoor rotary-type heat exchanger 5 serves as a condenser, while the outdoor rotary-type heat exchanger 3 serves as an evaporator.

The motor operated expansion valve 4 is a pulse motor valve (to be referred to as a PMV 4 hereinafter) whose opening degree Q continuously changes in accordance with the number of driving pulses supplied thereto.

The outdoor and indoor rotary-type heat exchangers 3 and 5 both have the function of a heat exchanger and the function of a fan. The two heat exchangers 3 and 5 are rotated by attached heat exchanger motors 3M and 5M, respectively, to take in and blow air and to perform heat exchange between air and the refrigerant. The detailed arrangements of the heat exchangers 3 and 5 will be described later.

A heat exchanger radiant temperature sensor 11 is mounted at the outdoor rotary-type heat exchanger 3. Upon reception of heat radiated from the outdoor rotary-type heat exchanger 3, the sensor 11 detects a temperature $Tc_2$ of the heat exchanger 3 in a noncontact manner.

A pressure sensor 12 is mounted in the pipe between the indoor rotary-type heat exchanger 5 and the 2-way valve 6. The pressure sensor 12 detects a pressure Po in the indoor rotary-type heat exchanger 5 through the pipe. Note that the pressure sensor 12 may be mounted at a position where it can detect a pressure in the outdoor rotary-type heat exchanger 3.

A suction refrigerant temperature sensor 13 is mounted on the suction pipe of the compressor 1. The suction refrigerant temperature sensor 13 detects a temperature $Tc_0$ of the refrigerant sucked into the compressor 1.

An indoor temperature sensor 14 is arranged at a position near the indoor rotary-type heat exchanger 5, at which the sensor 14 is not influenced by the temperature of the heat exchanger 5. The indoor temperature sensor 14 detects a temperature Ta of sucked indoor air.

An outlet temperature sensor 15, a heater-attached temperature sensor 16, and a heat exchanger radiant temperature sensor 17 are arranged near the indoor rotary-type heat exchanger 5.

The outlet temperature sensor 15 detects a temperature To of air heat-exchanged and blown by the indoor rotary-type heat exchanger 5.

The heater-attached temperature sensor 16 is constituted by a heater for generating a predetermined amount of heat, a plate (e.g., an aluminum plate) to which heat from the heater is applied, and a sensor for detecting a temperature Tz of the plate. The sensor 16 detects a change in the temperature Tz of the plate upon reception of blown air.

The heat exchanger radiant temperature sensor 17 receives heat radiated from the indoor rotary-type heat exchanger 5 to detect a temperature $Tc_1$ of the indoor rotary-type heat exchanger 5 in a noncontact manner.

A motor rotational speed sensor 58 is arranged near the heat exchanger motor 3M. The motor rotational speed sensor 58 detects a rotational speed Nu of the heat exchanger motor 3M.

A motor rotational speed sensor 18 is arranged near the heat exchanger motor 5M. The motor rotational speed sensor 18 detects a rotational speed Ni of the heat exchanger motor 5M.

A louver 19 is disposed at the outlet port of an air path formed by the indoor rotary-type heat exchanger 5. The louver 19 changes the direction of air and also variably adjusts the outlet air velocity by changing the opening area of the outlet port. The louver 19 is opened/closed by a motor 19M.

Figure 2:
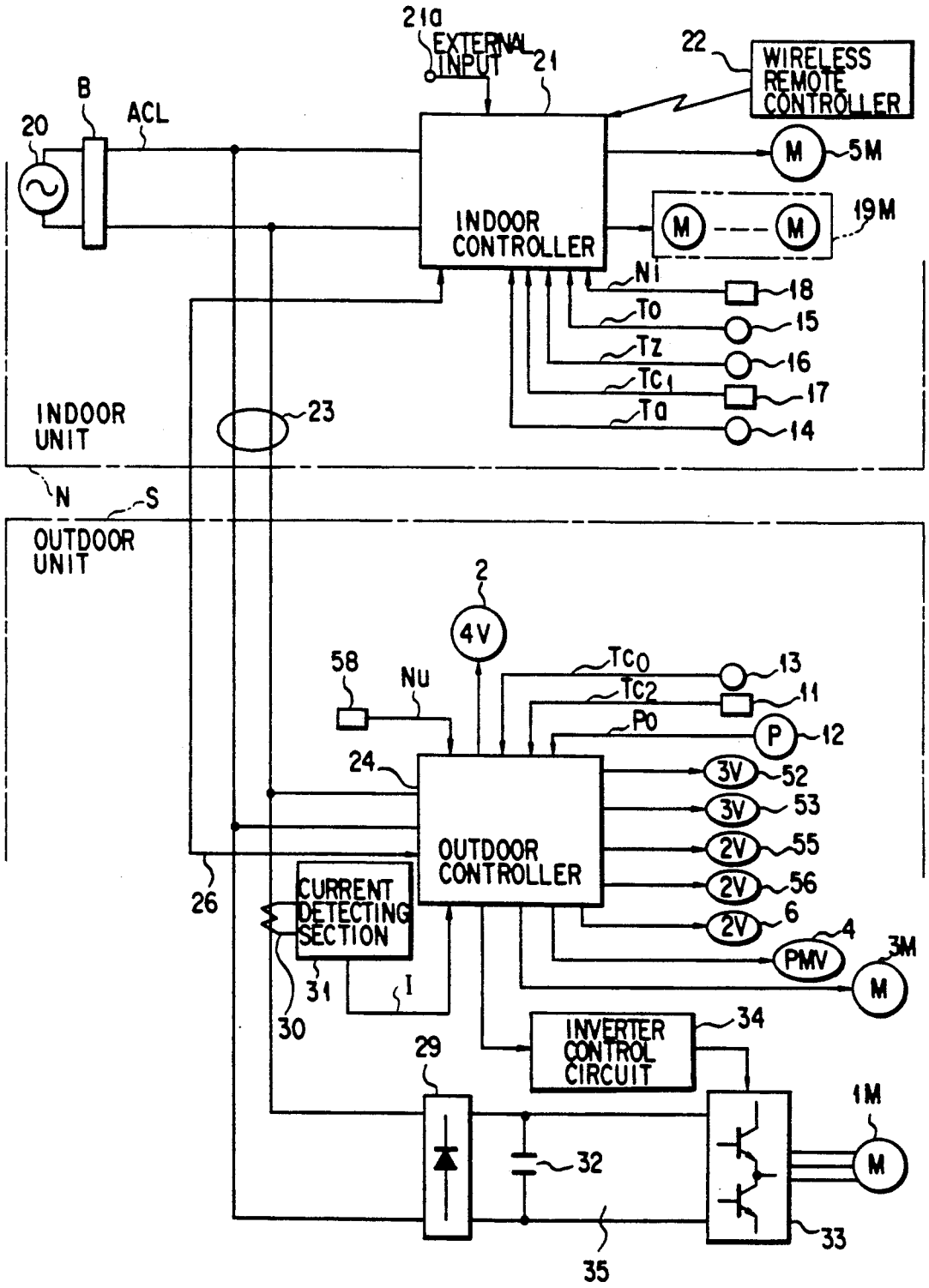
FIG. 2 is a block diagram showing the arrangement of a control system in FIG. 1.

A control system, which can be divided into control systems for an indoor unit N and an outdoor unit S, will be described next. As shown in FIG. 2, a lead-in cable ACL is connected to a 100-V commercial AC power supply 20 through a breaker B. An indoor controller 21 is connected to the lead-in cable ACL. The indoor controller 21 controls the air conditioner together with an outdoor controller 24 (to be described later) on the basis of an operation of a wireless operation unit (wireless remote controller) 22 or data input from an external input terminal 21*a*.

The outdoor controller 24 is connected to the lead-in cable ACL through a power line 23. The indoor and outdoor controllers 21 and 24 are connected to each other through a signal line 26.

A rectifier circuit 29 is connected to the power line 23. A current sensor 30 is attached to the power line 23. The current sensor 30 detects an input current I (to be referred to as an inverter current hereinafter) flowing from the commercial AC power supply 20 to the rectifier circuit 29 together with a current detecting section 31. This detection output is supplied to the outdoor controller 24.

A smoothing capacitor 32 is connected to the output terminal of the rectifier circuit 29. A switching circuit 33 is connected to the capacitor 32. The switching circuit 33 is driven by an inverter control circuit 34 which is operated on the basis of a command from the outdoor controller 24, thereby converting an input DC voltage into a voltage having a predetermined frequency (and a predetermined level) and outputting the voltage. This output serves as driving power for the compressor motor 1M.

That is, an inverter circuit 35 is constituted by the rectifier circuit 29, the capacitor 32, and the switching circuit 33. As an output frequency (to be referred to as an operating frequency) F of the inverter circuit 35 changes, the rotational speed, i.e., the capacity, of the compressor motor 1M changes.

The rectifier circuit 29 is constituted by a voltage doubler rectifier circuit and is designed to convert an input AC voltage of 100 V into an output DC voltage of about 290 V.

Note that devices and control circuits on the indoor side are mounted in the indoor unit N; and those on the outdoor side, in the outdoor unit S.

The indoor and outdoor controllers 21 and 24 will be described in detail below.

Figure 3:
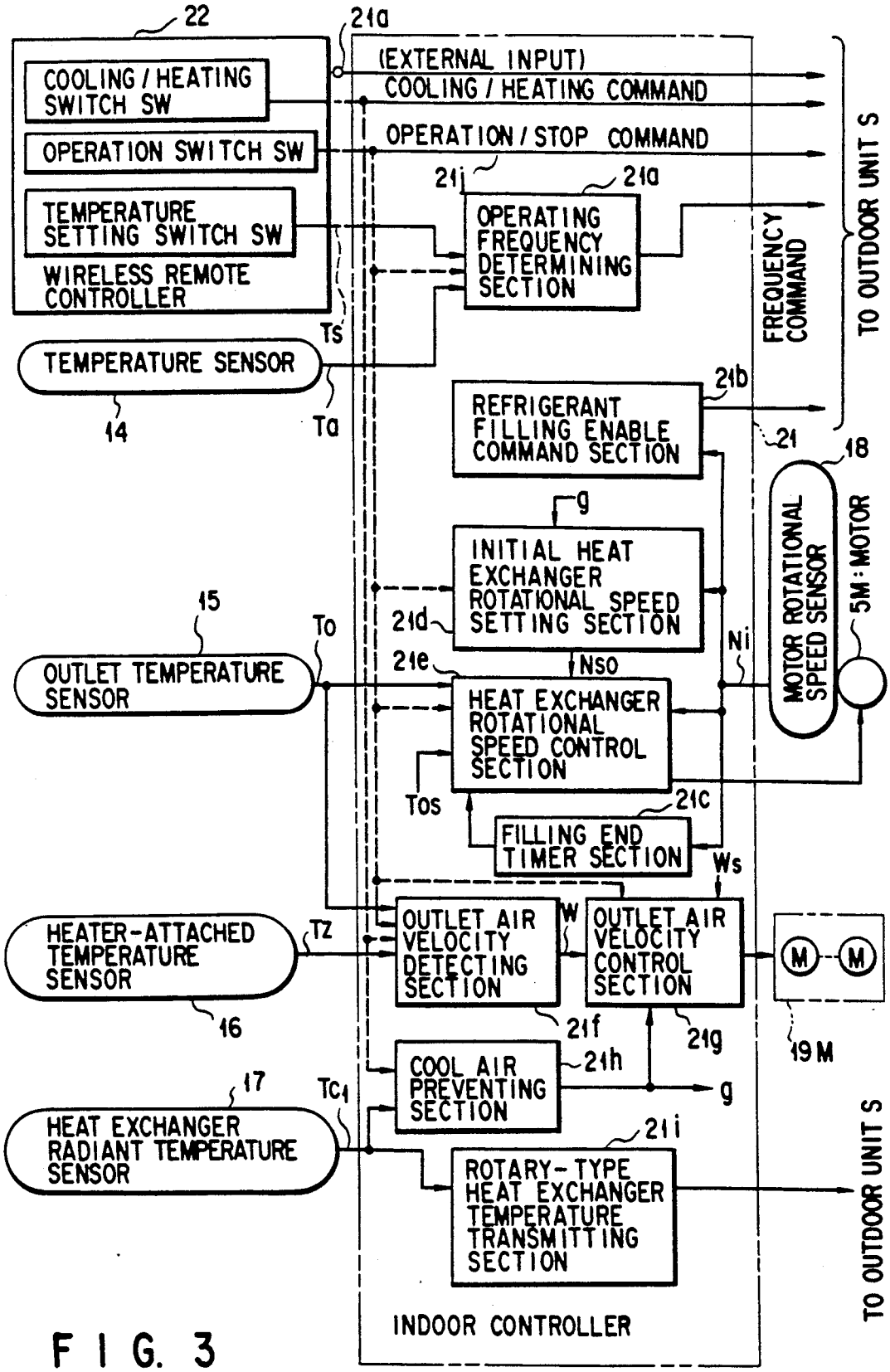
FIG. 3 is a block diagram showing the arrangement of an indoor controller in FIG. 2.

The indoor controller 21 mounted in the indoor unit N comprises a microprocessor and the like and has the following functional sections (1) to (10), which are shown in FIG. 3 in detail:

(1) an operating frequency determining section 21*a* for determining an operating frequency f of the compressor motor 1M to control the capacity of the compressor 1 in accordance with a difference $\Delta T$ ($=Ta-Ts$) between the indoor temperature Ta detected by the indoor temperature sensor 14 and a set indoor temperature Ts set through the remote controller 22, i.e., an air-conditioning load, thus generating a corresponding frequency command;

(2) a refrigerant filling enable command section 21*b* for generating a refrigerant filling enable command on the basis of the rotational speed Ni, of the heat exchanger motor 5M, detected by the motor rotational speed sensor 18, and supplying the command to the outdoor unit S;

(3) a filling end timer section 21*c* which is operated in accordance with the motor rotational speed Ni;

(4) an initial heat exchanger rotational speed setting section 21*d* for setting an initial rotational speed Nso of the heat exchanger motor 5M for refrigerant filling processing at the start of an operation on the basis of an operation/stop command from the remote controller 22, the motor rotational speed Ni, and an output g from a cool air preventing section 21*h* (to be described later);

(5) a heat exchanger rotational speed control section 21*e* for controlling the heat exchanger motor 5M on the basis of an operation/stop command from the remote controller 22, the initial rotational speed Nso, the motor rotational speed Ni, a set outlet temperature Tos, an outlet temperature To detected by the outlet temperature sensor 15, and an output signal from the filling end timer section 21*c;*

(6) an outlet air velocity detecting section 21*f* for detecting an outlet air velocity W at the outlet port on the basis of a cooling/heating command and an operation/stop command from the remote controller 22, the outlet temperature To, and the detection temperature Tz obtained by the heater-attached temperature sensor 16;

(7) an outlet air velocity control section 21*g* for controlling the motor 19M for the louver 19 at the outlet port on the basis of the outlet air velocity W, a set outlet air velocity Ws, an operation/stop command, and the output g from the cool air preventing section 21*h;*

(8) the cool air preventing section 21*h* for outputting a signal g to prevent blowing of cool air at the start of a heating operation on the basis of a cooling/heating command, the rotary-type heat exchanger temperature (=the temperature of the indoor rotary-type heat exchanger 5) $Tc_1$ detected by the heat exchanger radiant temperature sensor 17;

(9) a rotary-type heat exchanger temperature transmitting section 21*i* for transmitting the rotary-type heat exchanger temperature $Tc_1$ to the outdoor unit; and

(10) a transmitting section 21*j* for transmitting a cooling/heating command and an operation/stop command, output from the remote controller 22 and input to the external input terminal 21*a*.

Figure 4:
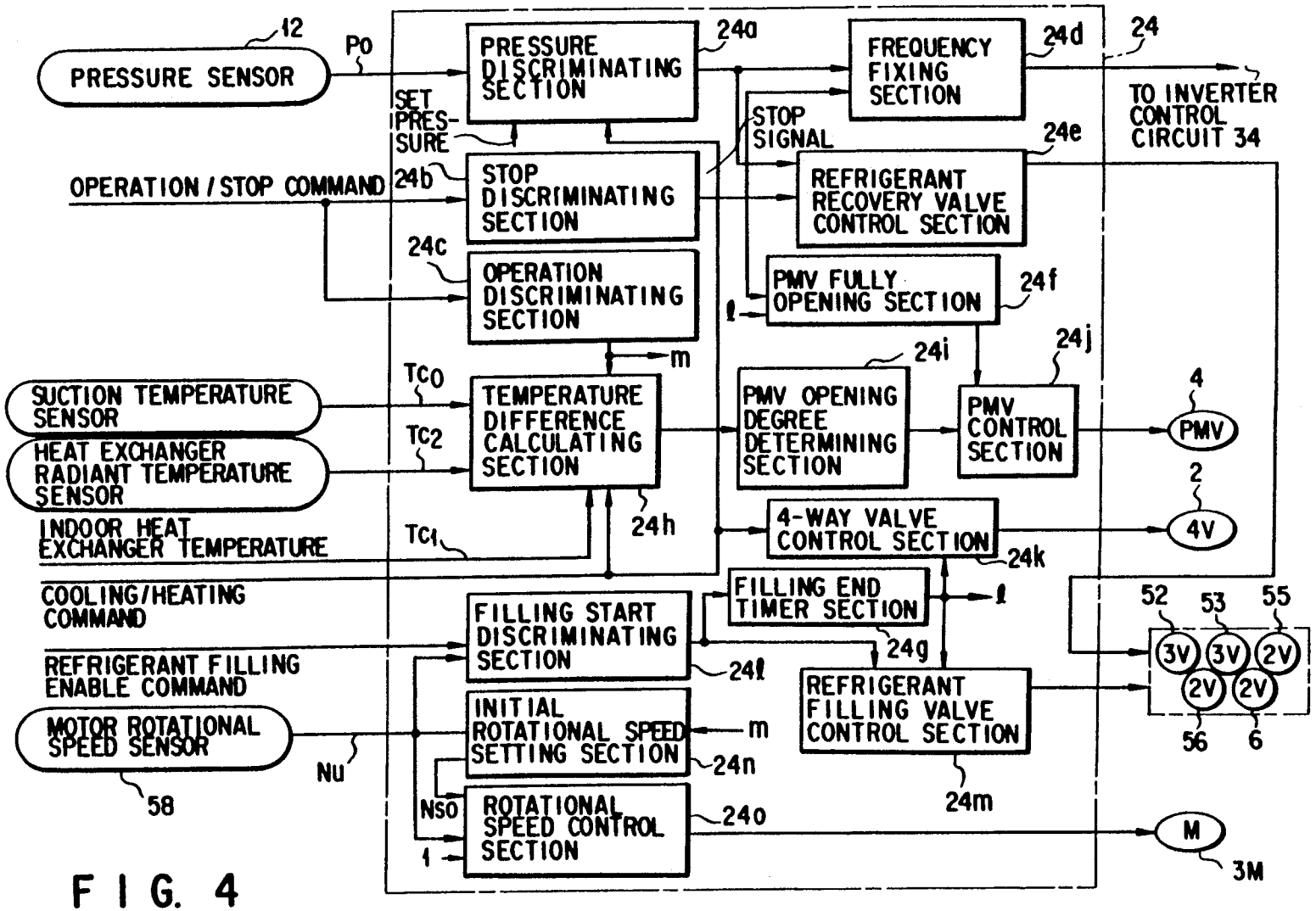
FIG. 4 is a block diagram showing the arrangement of an outdoor controller in FIG. 2.

The outdoor controller 24 mounted in the outdoor unit S comprises a microprocessor and the like and has the following functional sections (1) to (15), which are shown in FIG. 4 in detail:

(1) a pressure discriminating section 24*a* for receiving a cooling/heating signal and the pressure Po in the indoor rotary-type heat exchanger 5 and comparing the pressure Po with a set value (e.g., 0.8 atm in the cooling mode; 1.2 atm in the heating mode);

(2) a stop discriminating section 24*b* for generating a stop signal for stopping an operation on the basis of a stop command from the indoor unit N;

(3) an operation discriminating section 24*c* for generating an operation signal for executing an operation on the basis of an operation command from the indoor unit N;

(4) a frequency fixing section 24*d* for outputting a signal for fixing the operating frequency F of the compressor motor 1M to a predetermined refrigerant recovery value on the basis of an output signal from the pressure discriminating section 24*a* and a stop signal from the stop discriminating section 24*b;*

(5) a refrigerant recovery valve control section 24*e* for executing valve control for refrigerant recovery with respect to the valves 52, 53, 55, 56, and 6 on the basis of the output signal from the pressure discriminating section 24*a* and the stop signal from the stop discriminating section 24*b;*

(6) a PMV fully opening section 24*f* for generating a signal for fully opening the PMV 4 on the basis of a stop signal from the stop discriminating section 24*b* and an output signal l from a filling end timer section 24*g* (to be described later);

(7) a temperature difference calculating section 24*h* for calculating a temperature difference on the basis of the operation signal m, a cooling/heating command, the detection temperature (=the suction refrigerant temperature of the compressor 1) $Tc_0$ obtained by the suction refrigerant temperature sensor 13, the detection temperature (=the temperature of the outdoor rotary-type heat exchanger 3) $Tc_2$ obtained by the heat exchanger radiant temperature sensor 11, and the rotary-type heat exchanger temperature $Tc_1$ from the indoor unit N, which temperature difference corresponds to the degree of superheat of the refrigerant in a heat exchanger serving as an evaporator;

(8) a PMV opening degree determining section 24*i* for determining the opening degree of the PMV 4 to maintain the temperature difference (=degree of superheat) at a predetermined value during an operation;

(9) a PMV control means 24*j* for controlling the opening degree Q of the PMV 4 on the basis of an output signal from the PMV opening degree determining section 24*i* and an output signal from the PMV fully opening section 24*f;*

(10) a 4-way valve control section 24*k* for controlling a switching operation of the 4-way valve 2 on the basis of a cooling/heating command;

(11) a filling start discriminating section $24^2$ for discriminating the timing at which filling of the refrigerant is started, on the basis of a refrigerant filling enable command from the indoor unit N and the motor rotational speed Nu, of the heat exchanger motor 3M, detected by the motor rotational speed sensor 58;

(12) the filling end timer section 24*g* for counting a predetermined period of time required for filling the refrigerant, and generating a filling end command after the predetermined period of time, on the basis of an output signal from the filling start discriminating section 24*l;*

(13) a refrigerant filling valve control means 24*m* for executing valve control for filling the refrigerant with respect to the valves 52, 53, 55, 56, and 6 on the basis of the output signal from the filling start discriminating section 24*l* and the output signal l from the filling end timer section 24*g;*

(14) an initial heat exchanger rotational speed setting section 24*n* for setting the initial rotational speed Nso of the heat exchanger motor 3M to perform refrigerant filling processing at the start of an operation on the basis of the motor rotational speed Nu detected by the motor rotational speed sensor 58 and the operation signal m from the operation discriminating section 24*c;* and

(15) a rotational speed control section 24*o* for controlling the rotational speed of the heat exchanger motor 3M on the basis of the motor rotational speed Nu and the initial rotational speed Nso.

The respective portions constituting such an air conditioner will be described in detail below.

Figure 5:
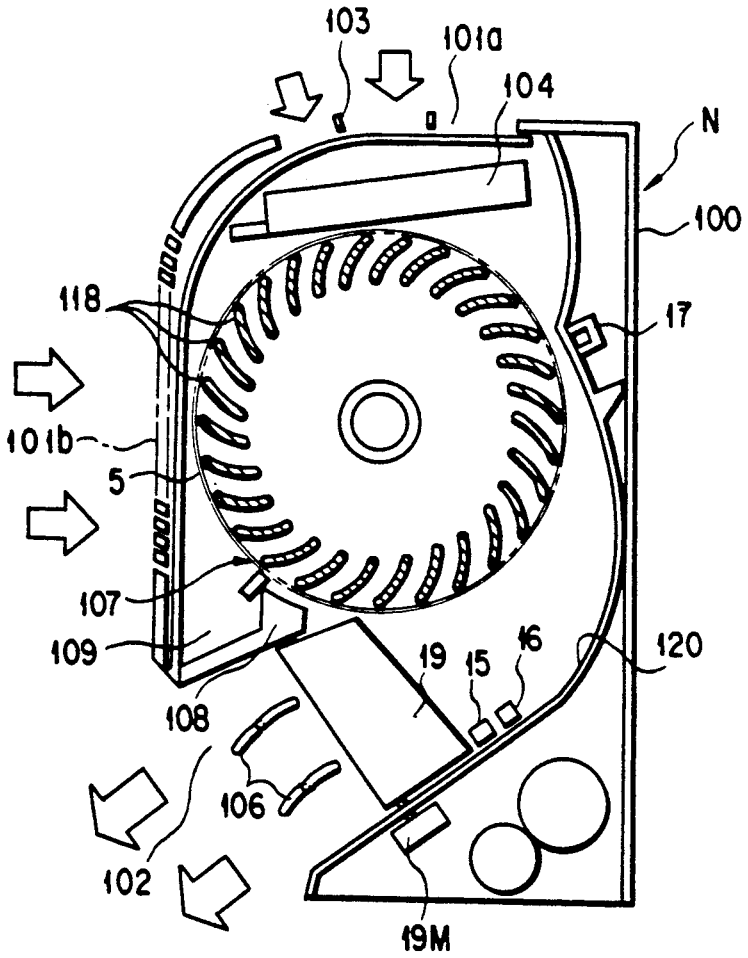
FIG. 5 is a longitudinal sectional side view of an indoor unit constituting the air conditioner according to the first embodiment of the present invention.
Figure 6:
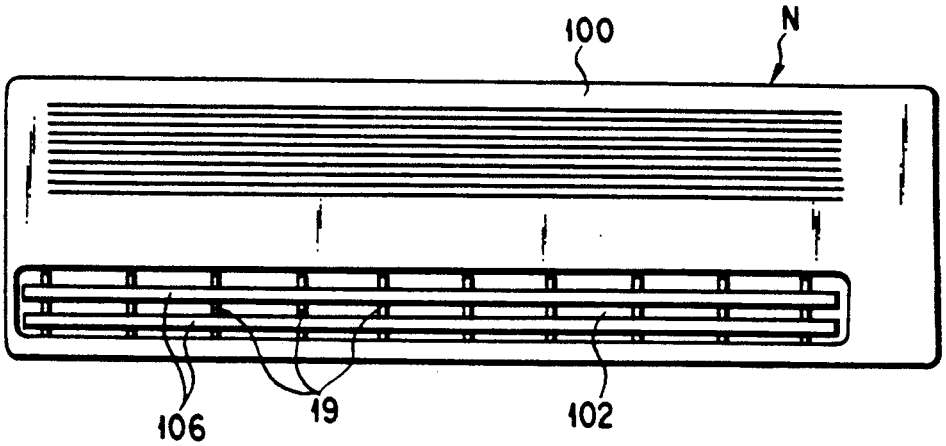
FIG. 6 is a front view of the indoor unit in FIG. 5.

FIGS. 5 and 6 show the internal arrangement of the indoor unit N containing the indoor rotary-type heat exchanger 5, the indoor controller 21, and the like. Upper and lower suction ports 101*a* and 101*b* are respectively formed in the upper and front surfaces of a unit main body 100, and an outlet port 102 is formed in a lower portion of the front surface. An electric dust collector 104 is arranged in the unit main body 100 to oppose a grill 103 disposed at the upper suction port 101*a*.

A large number of vertical louvers 19 are arranged at the outlet port 102 at predetermined intervals along the longitudinal direction. A plurality of horizontal louvers 106 are arranged in front of these louvers 19 at predetermined intervals in the vertical direction.

The vertical louvers 19 are respectively coupled to the rotating shafts of special driving motors 19M so as to be subjected predetermined pivot control. The horizontal louvers 106 are coupled to a driving mechanism (not shown) to be reciprocally driven in designated directions or fixed in a designated direction.

The remaining space in the unit main body 100, excluding the space in which the above components are arranged, is occupied by the indoor rotary-type heat exchanger 5 of a horizontal flow fan type. A brush unit 107 for preventing a drain from scattering is disposed above a nose portion 108 of the outlet port 102 so as to be in contact with a portion of the outer surface of the indoor rotary-type heat exchanger 5. A drain vessel portion 109 is disposed on the rotational direction side of the brush unit 107. A drain hose (not shown) is connected to the drain vessel portion 109.

Figure 7:
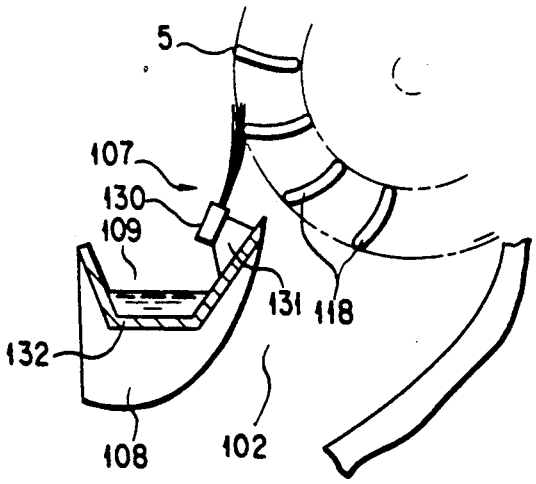
FIG. 7 is a side view of a drain removing brush unit used in the indoor unit in FIG. 5.

As shown in FIG. 7, the brush unit 107 is constituted by a brush body 130 having a distal end extended to be always brought into slidable contact with an end portion of each blade 118 constituting the indoor rotary-type heat exchanger 5, a mounting portion 131 for supporting the brush body 130, and a drain casing 132 which is fitted in the upper surface of the nose portion 108 to constitute the drain vessel portion 109, and on which the mounting portion 131 is mounted and fixed.

Figure 8:
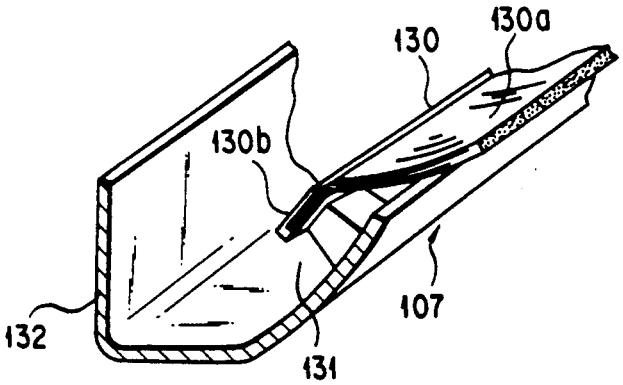
FIG. 8 is a perspective view of the brush unit with certain parts being omitted therefrom.
Figure 9:
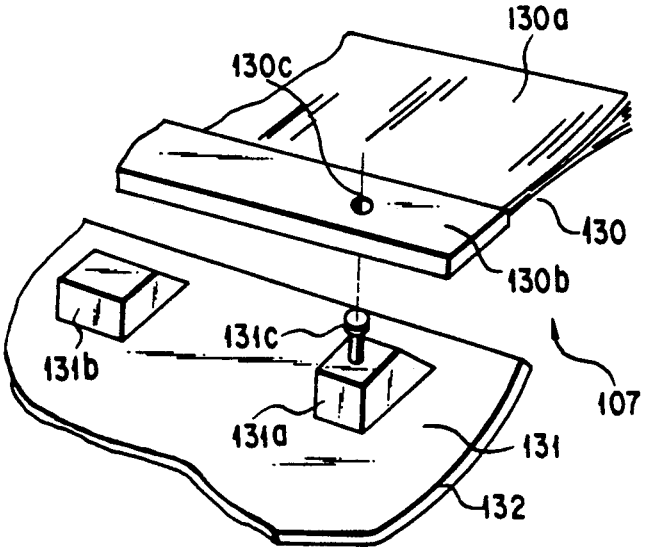
FIG. 9 is an exploded perspective view of the brush unit.

FIGS. 8 and 9 show the detailed arrangement of the brush unit 107. The brush body 130 is constituted by a brush 130*a* which is brought into direct contact with each blade 118, and a fitment 130*b* for holding the brush 130*a*. A mounting hole 130*c* is formed in the fitment 130*b*. With this arrangement, the brush body 130 is mounted and fixed to the mounting portion 131. Note that the longitudinal length of the brush body 130 is equal to the axial length of the indoor rotary-type heat exchanger 5, and that the two end portions of the brush body 130 and those of the heat exchanger 5 are aligned with each other.

The mounting portion 131 is constituted by a plurality of mounting bases 131*a* and 131*b* arranged at predetermined intervals in the longitudinal direction of the casing 132. A pin 131*c* extends from the mounting base 131*a* at a position corresponding to the mounting hole 130*c*. The pin 131*c* is inserted into the mounting hole 130*c* to be fixed by, e.g., caulking. The mounting base 131*b* without the pin 131*c* supports the fitment 130*b* of the brush body 130.

As is apparent, the brush unit 107 described above is mounted such that the bristle ends of the brush 130*a* face in the rotational direction of the indoor rotary-type heat exchanger 5. As shown in FIG. 9, the brush body 130 needs to be mounted on the mounting portion 131 at a sufficient inclination. In practice, the brush body 130 must be mounted to lie between each blade 118 and the drain vessel portion 109.

Figure 10:
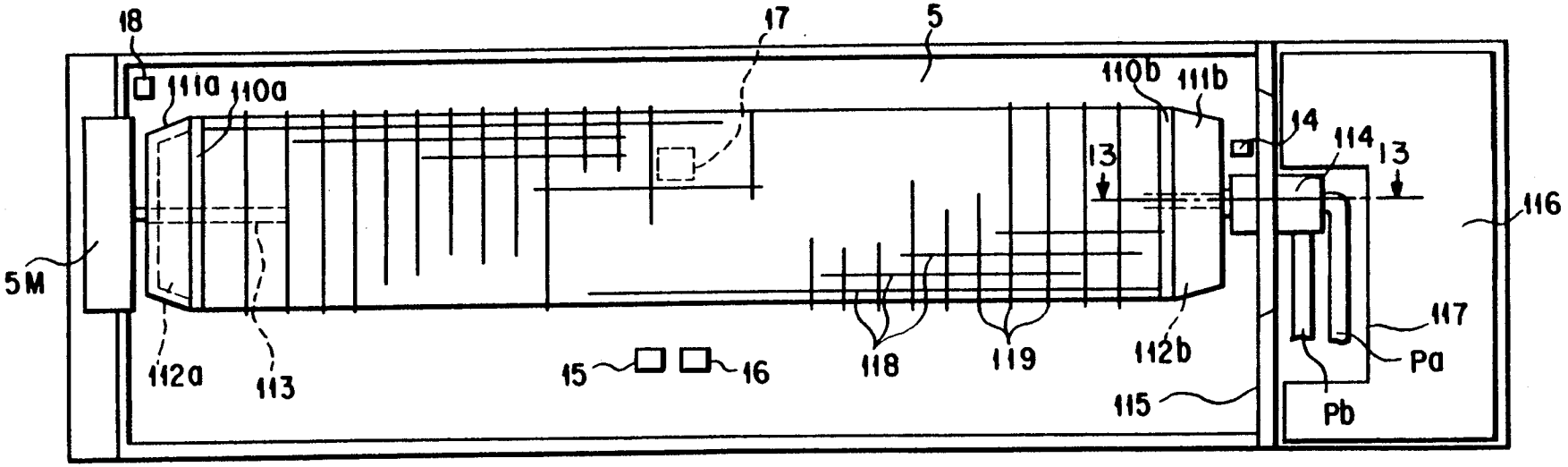
FIG. 10 is a front view of an indoor rotary-type heat exchanger used in the indoor unit in FIG. 5.

As shown in FIG. 10, in the indoor rotary-type heat exchanger 5, covers 111*a* and 111*b* are respectively disposed on two end plates 110*a* and 110*b* to form chambers 112*a* and 112*b*. One chamber 112*a* will be referred to as a chamber A; and the other chamber 112*b*, a chamber B.

The rotating shaft of the heat exchanger motor 5M for driving the indoor rotary-type heat exchanger 5 is coupled to the cover 111*a* constituting the chamber A 112*a*. An end portion of a center pipe 113 is inserted and fitted in the end plate 110*a* constituting the chamber A 112*a*. The end portion of the center pipe 113 communicates with the chamber A 112*a*. The center pipe 113 also extends through the other end plate 110*b* and is rotatably supported on a flow divider 114 (to be described later).

The flow divider 114 is supported in such a manner that the two ends protrude from a partition plate 115. An electric component box 116 containing electric components (not shown) is arranged in a space into which the flow divider 114 protrudes from the partition plate 115. A portion, of the flow divider 114, which protrudes toward the electric component box 116, and refrigerant pipes Pa and Pb connected to the flow divider 114 are enclosed with a heat-resistant plate 117 so as not to be thermally influenced by the electric components.

A large number of blades 118 are arranged between the end plates 110*a* and 110*b* at predetermined intervals in the circumferential direction while they are curved in a predetermined direction. A large number of fins 119 are arranged at proper intervals along the axial direction of the blades 118. The indoor temperature sensor 14 is arranged near the two suction ports 101*a* and 101*b* (see FIG. 7).

The outlet temperature sensor 15 and the heater-attached temperature sensor 16 are arranged midway along an outlet air path at positions near the vertical louvers 19. The heat exchanger radiant temperature sensor 17 is arranged on the rear surface side of an air path forming plate 120. The motor rotational speed sensor 18 is arranged near the heat exchanger motor 5M.

Figure 11:
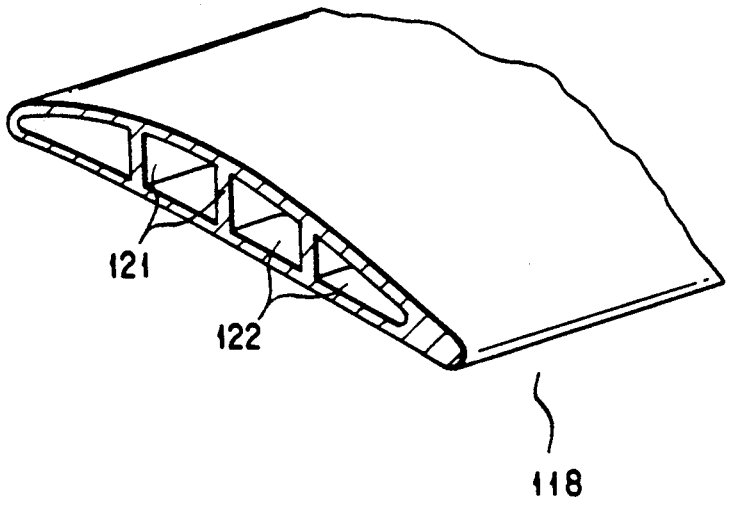
FIG. 11 is a perspective view, partially in cross-section, of a blade in FIG. 10.

As shown in FIG. 11, each blade 118 described above is formed by extrusion molding using an aluminum material. In the blade 118, a plurality of partition walls 121 are formed at predetermined intervals in the longitudinal direction to form a plurality of partition chambers 122 in the longitudinal direction. The refrigerant f1 guided into the chamber A 112*a* through the center pipe 113 simultaneously flows into these partition chambers 122. With this structure, the indoor rotary-type heat exchanger 5 can have a large heat exchange area and hence is excellent in heat exchange efficiency.

Figure 12:
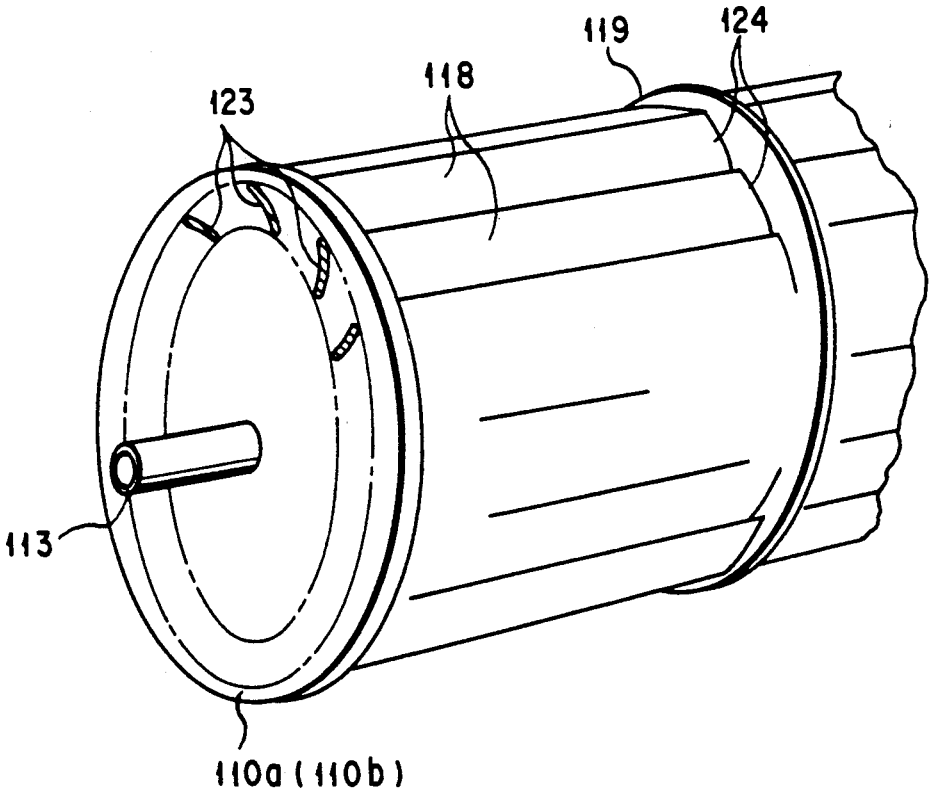
FIG. 12 is a perspective view showing part of a rotary-type heat exchanger in FIG. 10.

As shown in FIG. 12, both end portions of each blade 118 are fitted in engaging holes 123 formed in the end plates 110*a* and 110*b* and having the same sectional shape to be held. Each fin 119 described above is a thin aluminum plate. Engaging holes 124 are also formed in each fin 119 to allow the blades 118 to extend therethrough. The end plates 110*a* and 110*b* and the fins 119 are temporarily assembled with the blades 118, and the center pipe 113 is temporarily assembled with the end plates 110*a* and 110*b*. Thereafter, these components are subjected to blazing in a furnace, and the respective coupled portions are completely sealed.

Figure 13:
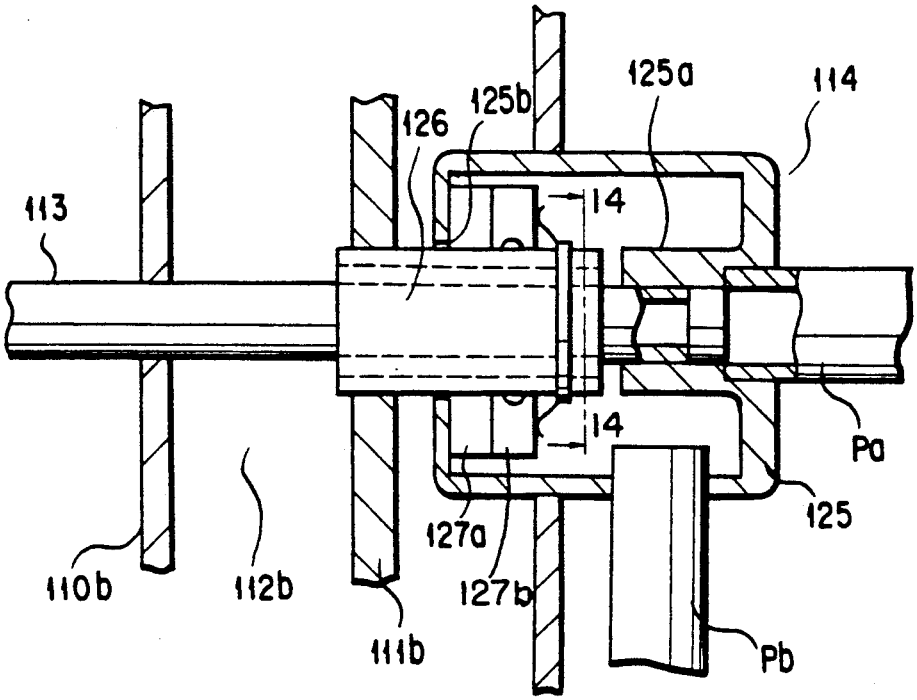
FIG. 13 is a longitudinal sectional view of a flow divider in FIG. 10.

FIG. 13 shows the arrangement of the flow divider 114 described above. A guide pipe 126 is fitted on the center pipe 113 extending through the end plate 110*b* at a position corresponding to the penetrated portion of the cover 111*b* and an end face penetrated portion 125*b* of a housing 125 of the flow divider 114.

In the housing 125, a stationary seal plate 127*a* and a rotating seal plate 127*b*, which are fixed to each other in tight contact, are fitted on the guide pipe 126, thus constituting a mechanical seal for ensuring the air tight state with respect to outer air.

An end portion of the center pipe 113 protrudes from the guide pipe 126 in the housing 125. This protruding end portion is rotatably supported by a boss portion 125*a* integrally formed on an opposing end face of the housing 125. The refrigerant pipe Pa communicating with the outdoor rotary-type heat exchanger 3 is connected to the boss portion 125*a* through the PMV 4. The refrigerant pipe Pb communicating with the 4-way valve 2 is connected to a lower portion of the flow divider 114 in FIG. 13 through a parallel circuit of the 2-way valves 55 and 56 and the capillary tube 57. The refrigerant pipe Pb receives the refrigerant which reaches the chamber B 112*b* through the partition chambers 122 of the blades 118.

Figure 14:
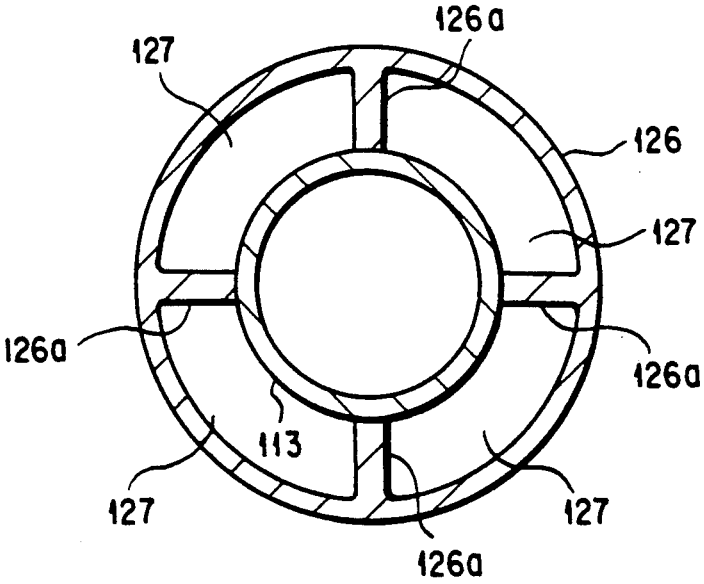
FIG. 14 is a longitudinal sectional view taken along a line Y—Y in FIG. 13.

As shown in FIG. 14, the center pipe 113 and the guide pipe 126 are concentrically arranged, and a plurality of leg portions 126*a* radially and integrally extend from the inner wall of the guide pipe 126. The respective leg portions 126*a* are tightly fitted on the outer wall of the center pipe 113 to form a plurality of flow paths 127 which axially divide the space between the center pipe 113 and the guide pipe 126.

Figure 15B:
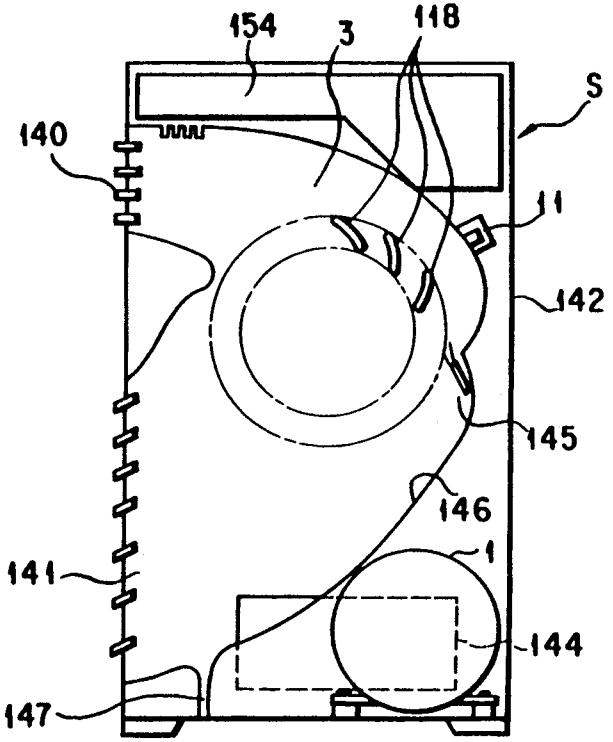
FIGS. 15A and 15B are a partly cutaway front view and a side view, respectively, showing an outdoor unit used for the air conditioner of the present invention.
Figure 15A:
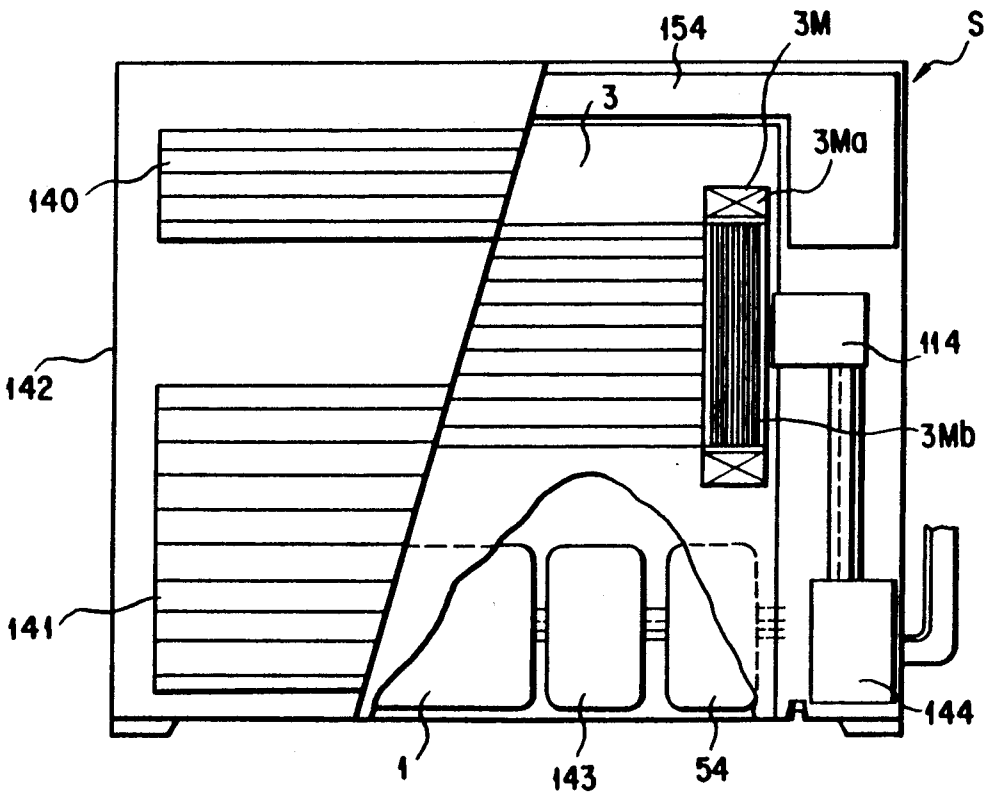

FIGS. 15A and 15B show the arrangement of the outdoor unit S. An outer air suction port 140 and an outlet port 141 are respectively formed in upper and lower portions of the front surface of a unit main body 142. The outdoor rotary-type heat exchanger 3 is arranged in the unit main body 142. In addition, the lateral compressor 1, a suction cap 143, a tank 54, and an integral pipe unit 144 are arranged and stored in the unit main body 142.

Similar to the indoor rotary-type heat exchanger 5 described above, the outdoor rotary-type heat exchanger 3 is of a lateral flow fan type. The arrangement of the outdoor rotary-type heat exchanger 3 is the same as that of the indoor rotary-type heat exchanger 5 except for the heat exchanger motor 3M (to be described later). In addition, the two heat exchangers 3 and 5 are connected to the same flow divider 114. Therefore, a repetitive description will be omitted.

The heat exchanger motor 3M is integrally coupled to an end portion of the outdoor rotary-type heat exchanger 3 on the flow divider 114 side. A rotor portion 3Mb, formed by stacking a large number of iron plates on each other, has the same diameter as that of the outdoor rotary-type heat exchanger 3, and is directly fixed to its end face. A stator portion 3Ma is fixed to the unit main body 142 by a proper means so as to leave a narrow gap between the outer surface of the rotor portion 3Mb and itself.

That is, the heat exchanger motor 3M is arranged to constitute a portion of the outdoor rotary-type heat exchanger 3. As a result, the heat exchanger motor 3M has a sufficiently large diameter and can generate a larger torque.

The bristle ends of a defrosting brush unit 145 are brought into slidable contact with the circumferential end portion of each blade 118 constituting the outdoor rotary-type heat exchanger 3. The defrosting brush unit 145 is constituted by a brush body identical to that of the brush unit 107 shown in FIGS. 7 to 9, and is fixed at a predetermined portion of an air path forming plate 146.

Similar to the brush unit 107, the direction of each brush bristle of the defrosting brush unit 145 is aligned with the rotational direction of the outdoor rotary-type heat exchanger 3. In this case, the air path forming plate 146 guides removed frost, i.e., a drain. A drainage hole 147 is formed in a lower end portion of the air path forming plate 146.

The heat exchanger radiant temperature sensor 11 is fixed to a predetermined portion of the rear surface of the air path forming plate 146.

The integral pipe unit 144 is a control block in which all the following components are integrally arranged: the 4-way valve 2, the PMV 4, a check valve arranged as needed, a pair of connection valve (so-called packed valves) for connecting the pipes disposed between the indoor and outdoor units N and S, and pipe portions for causing these components to communicate with each other.

In the integral pipe unit 144, capillary tubes for balancing the pressure may be required in the refrigerant flow paths before and after the PMV 4. In such a case, small holes may be formed in the block at positions corresponding to the flow paths.

An operation in the above-described arrangement will be described below.

An overall operation will be described first.

In the cooling mode, the refrigerant discharged from the compressor 1 flows into the outdoor rotary-type heat exchanger 3 through the 3-way valves 52 and 53, the 4-way valve 2, and the 2-way valve 55. The outdoor rotary-type heat exchanger 3 is rotated by the heat exchanger motor 3M. Upon this rotation, outer air is drawn. This drawn air is heat-exchanged with the refrigerant in the outdoor rotary-type heat exchanger 3. As a result, the refrigerant in the outdoor rotary-type heat exchanger 3 is condensed.

The refrigerant flowing through the outdoor rotary-type heat exchanger 3 is decompressed by the PMV 4 and enters the indoor rotary-type heat exchanger 5. The indoor rotary-type heat exchanger is rotated by the heat exchanger motor 5M. Upon this rotation, indoor air is drawn. The drawn air is cooled down upon heat exchange with the refrigerant in the indoor rotary-type heat exchanger 5, and is blown, as cool air, into the room.

The refrigerant evaporated in the indoor rotary-type heat exchanger 5 is sucked into the suction port 1*b* of the compressor 1 through the 2-way valve 6 and the 4-way valve 2.

In the heating mode, the refrigerant discharged from the discharge port 1*a* of the compressor 1 flows into the indoor rotary-type heat exchanger 5 through the 3-way valves 52 and 53, the 4-way valve 2, and the 2-way valve 6.

The indoor rotary-type heat exchanger 5 is rotated by the heat exchanger motor 5M. Upon this rotation, indoor air is drawn. This drawn air is heated upon heat exchange with the refrigerant in the indoor rotary-type heat exchanger 5, and is blown, as warm air, into the room.

In the indoor rotary-type heat exchanger 5, the refrigerant is condensed. The refrigerant is then decompressed by the PMV 4 and enters the outdoor rotary-type heat exchanger 3 to be evaporated. The refrigerant flowing through the outdoor rotary-type heat exchanger 3 is sucked by the compressor 1 through the 2-way valve 55 and the 4-way valve 2.

A control operation of the air conditioner having the above-described structure according to this embodiment will be described below.

Figure 16:
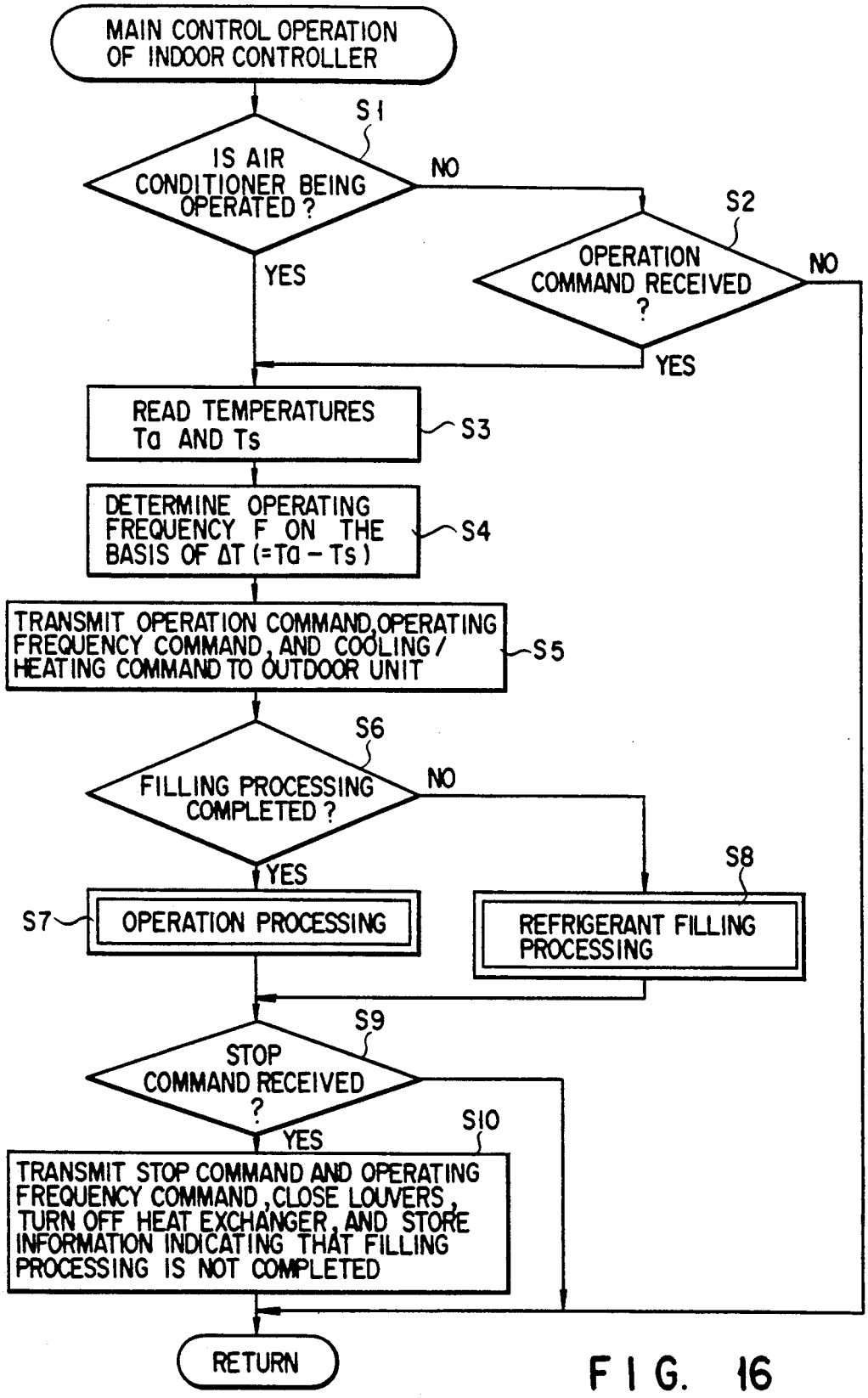
FIG. 16 is a flow chart for explaining a main control operation of the indoor controller in FIG. 3.

A main control operation performed by the indoor controller 21 will be described first with reference to the flow chart in FIG. 16.

When an operation switch **22*b* of the remote controller 22 is turned on, and an operation command is input, the detection temperature Ta obtained by the indoor temperature sensor 14 and the set indoor temperature Ts set through a temperature setting switch 22*c* of the remote controller 22 are read, and the temperature difference $\Delta T$ (=Ta−Ts), i.e., an air-conditioning load, is obtained (steps S1 to S3**).

The operating frequency f of the compressor 1 is determined on the basis of the temperature difference $\Delta T$, i.e., the air-conditioning load, and the corresponding operating frequency command is supplied to the outdoor unit S together with the operation command and a cooling/heating command based on the operation of the remote controller 22 (steps S4 and S5).

At the start of an operation, refrigerant filling processing is executed first with respect to the outdoor rotary-type heat exchanger 3 and the indoor rotary-type heat exchanger 5 on the basis of information indicating that filling processing is not completed, stored in an internal memory (not shown) incorporated in the indoor controller 21. Thereafter, normal operation processing is performed (steps S6 to S8).

When the operation switch **22*b* of the remote controller 22 is turned off, and a stop command is input, the stop command and the operating frequency command are supplied to the outdoor unit S. In addition, the louvers 19 at the outlet port are closed, and the rotation of the indoor rotary-type heat exchanger 5 is stopped. At the same time, the information indicating that filling processing is not completed is stored in the internal memory (not shown) (steps S9 and S10**).

Figure 17:
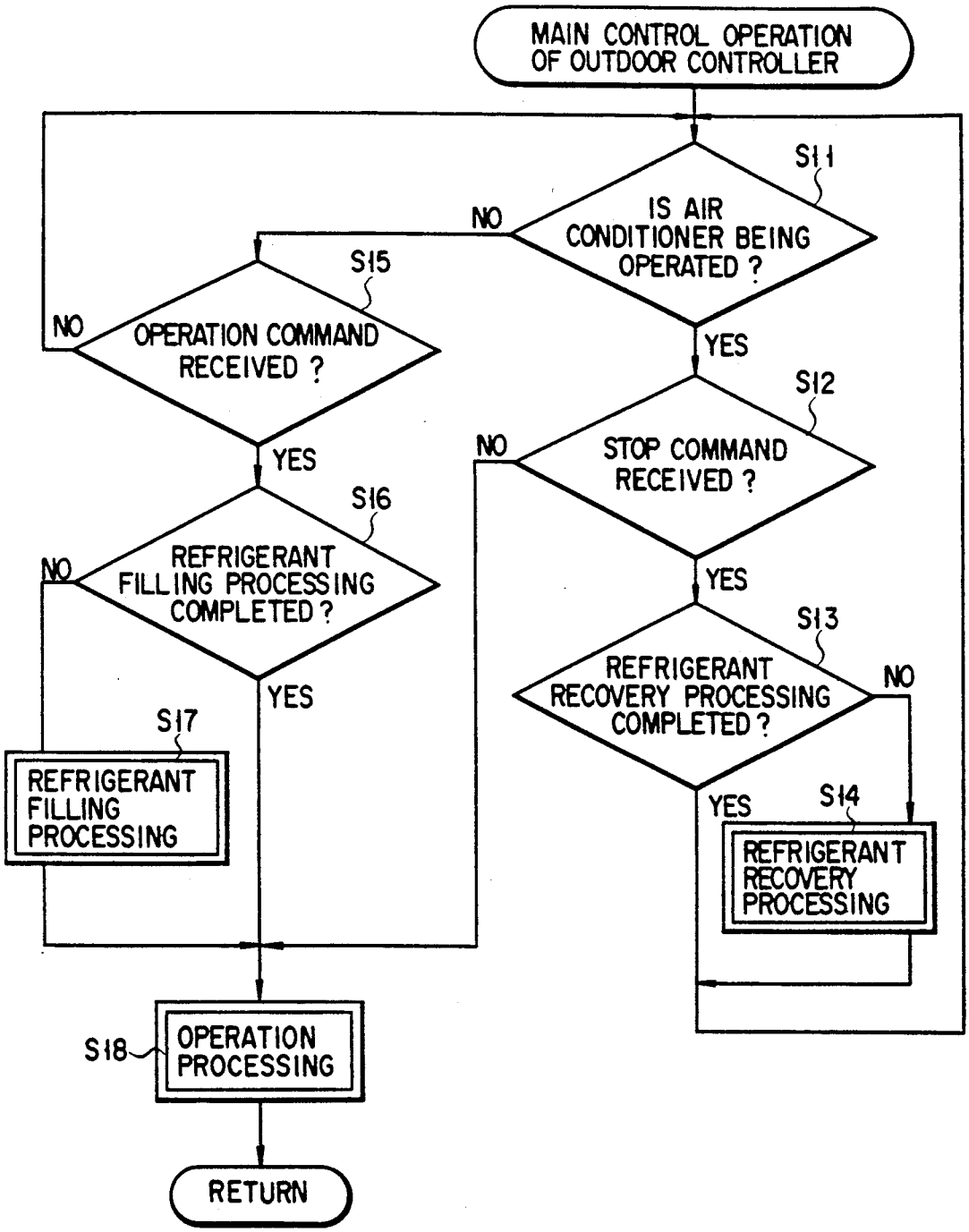
FIG. 17 is a flow chart for explaining a main control operation of the outdoor controller in FIG. 3.

FIG. 17 shows a main control operation performed by the outdoor controller 24

During an operation, operation processing is executed. When, however, a stop command is input, refrigerant recovery processing is executed with respect to the outdoor rotary-type heat exchanger 3 and the indoor rotary-type heat exchanger 5 (steps S11 to S14).

When an operation command is input, refrigerant filling processing is executed first with respect to the outdoor rotary-type heat exchanger 3 and the indoor rotary-type heat exchanger 5 on the basis of the information, indicating that filling processing is not completed, stored in the internal memory (not shown). Thereafter, normal operation processing is performed (steps S11 to S18).

(a) indoor heat exchange operation processing, (b) outdoor heat exchange operation processing, (c) refrigerant recovery processing, (d) indoor refrigerant filling processing, and (e) outdoor refrigerant filling processing will be respectively described below.

Figure 18:
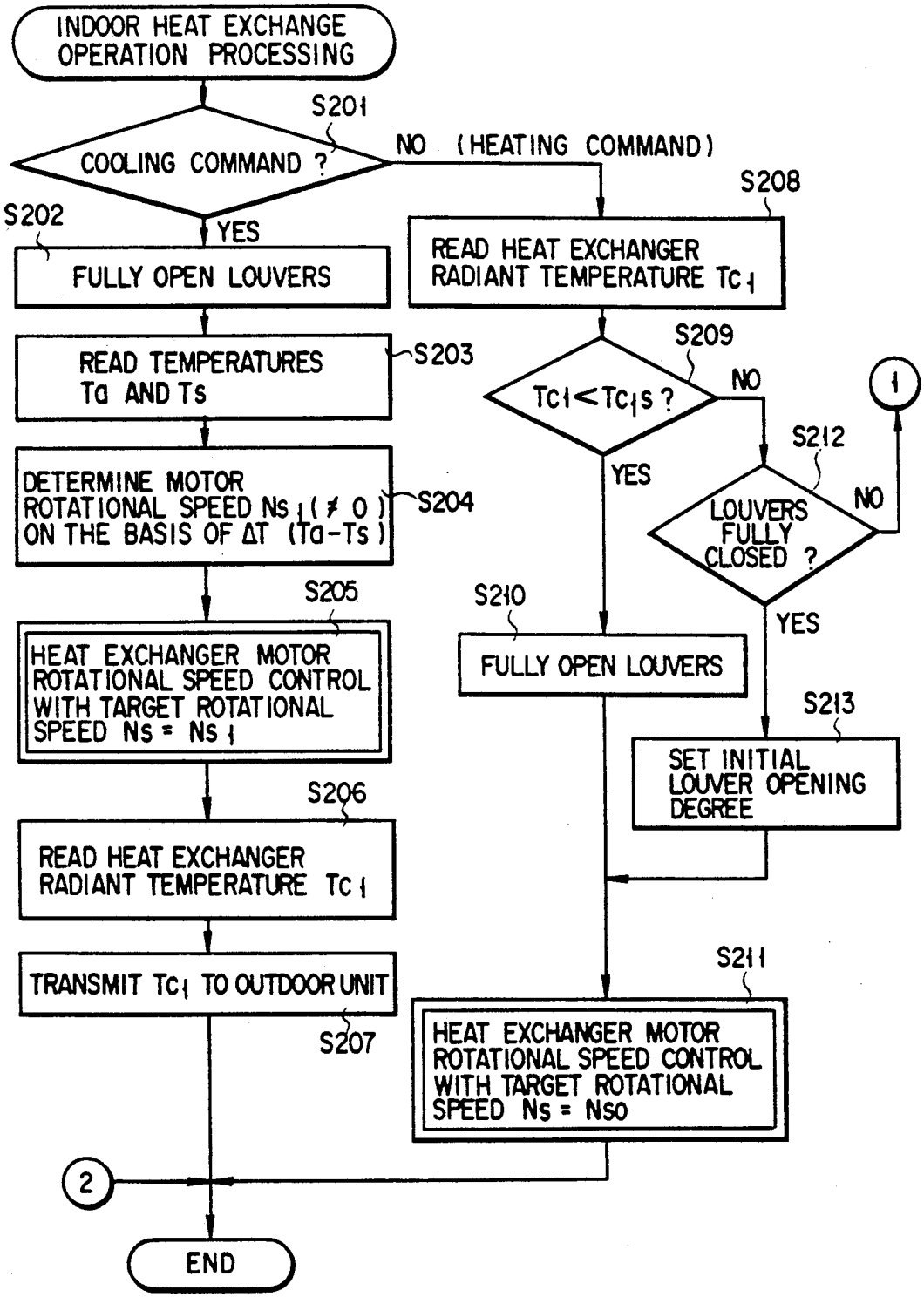
FIG. 18 is a flow chart for explaining an indoor operation performed by the indoor controller in FIG. 3.
Figure 19:
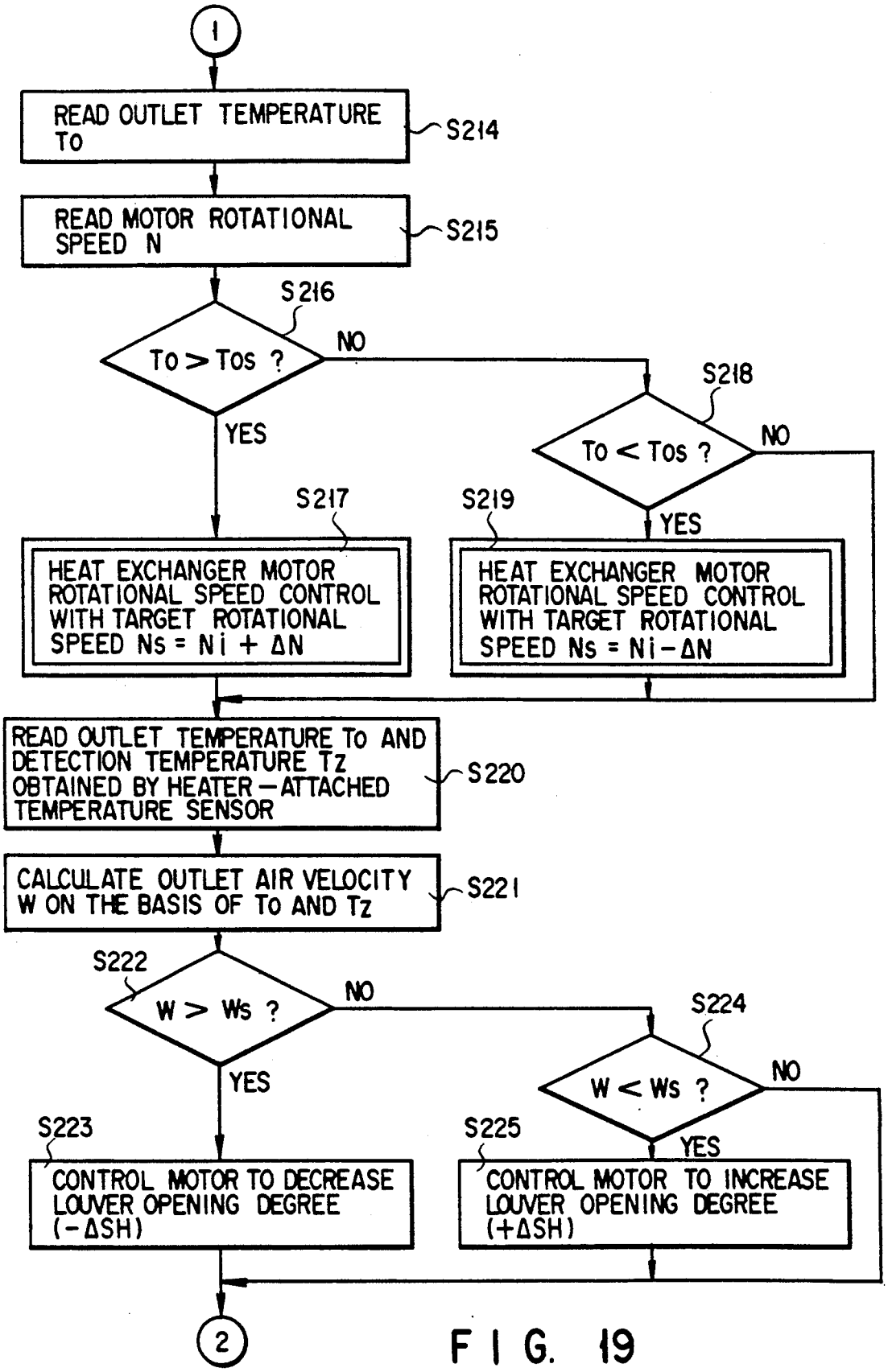
FIG. 19 is a flow chart for explaining the indoor operation performed by the indoor controller.

(a) Indoor heat exchange operation processing (the flow charts in FIGS. 18 and 19)

When a cooling command is input through a cooling/heating switch **22*a* of the remote controller 22, the motors 19M are driven to fully open the louvers 19 at the outlet port (steps S201 and S202**).

The indoor temperature Ta and the set indoor temperature Ts are read, and the motor rotational speed $Ns_1$ ($\neq 0$) with respect to the indoor rotary-type heat exchanger 5 is determined on the basis of the temperature difference $\Delta T$ (=Ta−Ts) (steps S203 and S204).

The rotational speed $Ns_1$ is set as a target rotational speed Ns, and heat exchanger motor rotational speed control with respect to the heat exchanger motor 5M is performed in such a manner that the motor rotational speed Ni detected by the motor rotational speed sensor 18 coincides with the target rotational speed Ns (step S205). This heat exchanger motor rotational speed control will be described later as (a').

The temperature $Tc_1$ of the indoor rotary-type heat exchanger 5 is detected by the heat exchanger radiant temperature sensor 17 in a noncontact manner and is read. The read data is supplied to the outdoor unit S (steps S206 and S207).

When a heating command is input through the remote controller 22 in step S201, the detection temperature $Tc_1$ obtained by the heat exchanger radiant temperature sensor 17 is read and compared with a set temperature $Tc_{1s}$ which is set to prevent blowing of cool air (steps S208 and S209).

If it is determined in step S209 that the temperature $Tc_1$ is still lower than the temperature $Tc_{1s}$ ($Tc_1 < Tc_{1s}$), the motors 19M are driven to fully open the louvers 19 at the outlet port (steps S210). With this operation, blowing of cool air into the room can be prevented without stopping the rotation of the indoor rotary-type heat exchanger 5.

The initial rotational speed Nso, which is set to be relatively small for a starting operation, is set as the target rotational speed Ns, and heat exchanger motor rotational speed control with respect to the heat exchanger motor 5M is executed in such a manner that the motor rotational speed Ni detected by the motor rotational speed sensor 18 coincides with the target rotational speed Ns (step S211).

If it is determined in step S209 that the temperature $Tc_1$ is equal to or higher than the temperature $Tc_{1s}$ ($Tc_1 \geqq Tc_{1s}$), and the louvers 19 are still fully closed, the louvers 19 are opened to a predetermined initial opening degree (steps S212 and S213). In this case, since the indoor rotary-type heat exchanger 5 is kept rotated, air can be smoothly and quickly blown.

If it is determined in step S212 that the louvers 19 are opened to the initial opening degree, the outlet temperature To detected by the outlet temperature sensor 15 and a motor rotational speed N are read, and the temperature To is compared with the set outlet temperature Tos which is higher than the temperature To (steps S214 to S216).

If it is determined in step S218 that the temperature To is higher than the temperature Tos (To>Tos), a value (Ni+$\Delta$N) obtained by adding a value $\Delta$N corresponding to one step to the current motor rotational speed Ni is set as the target rotational speed Ns, and heat exchanger motor rotational speed control with respect to the heat exchanger motor 5M is executed (step S217).

If it is determined in step S218 that the temperature To is lower than the temperature Tos (To<Tos), a value (Ni−$\Delta$N) obtained by subtracting the value $\Delta$N corresponding to one step from the current motor rotational speed Ni is set as the target rotational speed Ns, and heat exchanger motor rotational speed control with respect to the heat exchanger motor 5M is executed (steps S218 and S219).

In this manner, the rotational speed of the indoor rotary-type heat exchanger 5 is increased/decreased to cause the outlet temperature To and the set outlet temperature Tos to coincide with each other.

In addition to the outlet temperature To, the detection temperature Tz obtained by the heater-attached temperature sensor 16 is read, and the outlet air velocity W at the outlet port is detected on the basis of the two read temperatures (steps S220 and S221).

Figure 20:
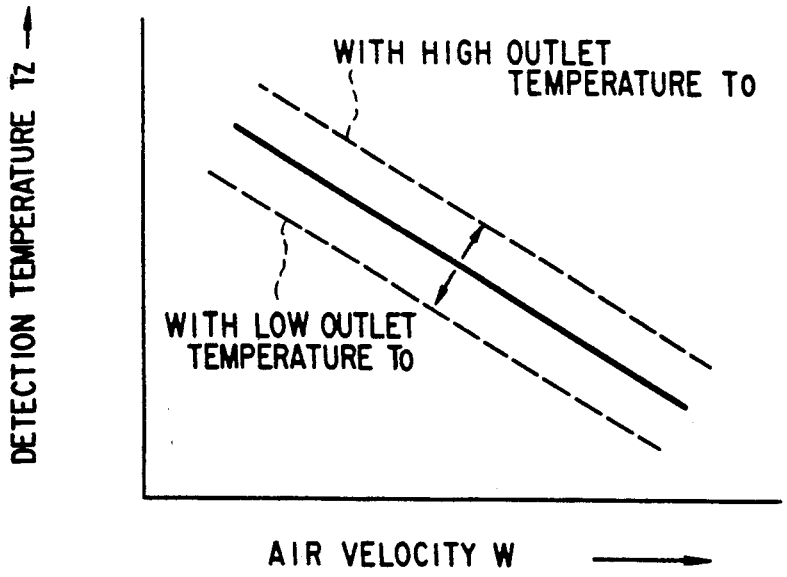
FIG. 20 is a graph for explaining air velocity detection performed by the indoor controller.

As described above, the heater-attached temperature sensor 16 is constituted by the heater for generating a predetermined amount of heat, the plate (e.g., an aluminum plate) to which heat generated by the heater is applied, and the sensor for detecting the temperature Tz of the plate. The plate is designed to receive outlet air. As shown in FIG. 20, the temperature Tz decreases as the air velocity increases, and the temperature Tz is shifted upward/downward in accordance with the outlet temperature To as a parameter.

The characteristics of the heater-attached temperature sensor 16 are stored beforehand in the internal memory (not shown), and the outlet temperature To and the detection temperature Tz are monitored on the basis of the characteristics, thereby calculating the outlet air velocity W.

The outlet air velocity W is compared with the set outlet air velocity Ws (step S222).

If the velocity W is higher than the velocity W ($W>Ws$), the motor 19M is controlled such that the current opening degree of the louvers 19 is decreased by $\Delta SH$ corresponding to one step (step S223).

If the velocity W is lower than the velocity Ws ($W<Ws$), the motor 19M is controlled such that the current opening degree of the louvers 19 is increased by $\Delta SH$ corresponding to one step (steps S224 and S225).

In this manner, the outlet area of the outlet is adjusted to cause the outlet velocity W and the set outlet velocity Ws to coincide with each other.

Figure 21:
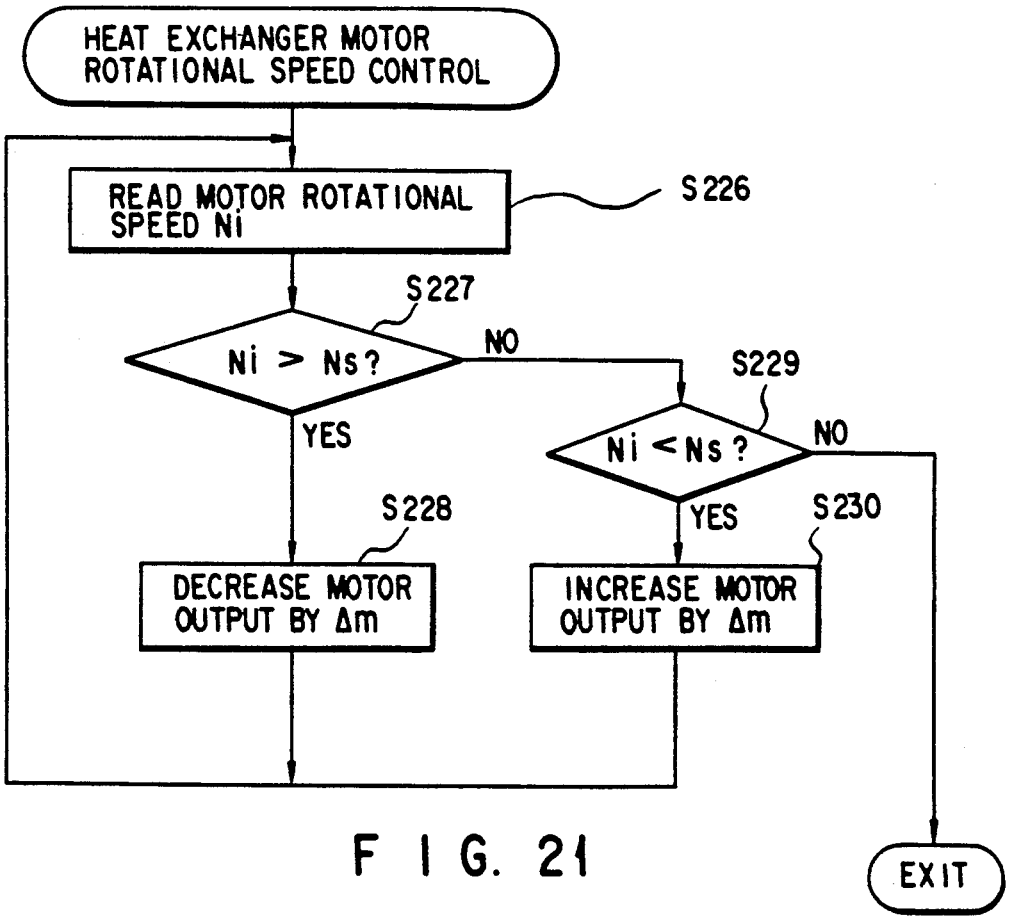
FIG. 21 is a flow chart for explaining control of the rotational speed of a heat exchanger motor by means of the indoor controller.

(a') Heat exchanger motor rotational speed control (see the flow chart in FIG. 21)

If the rotational speed Ni of the heat exchanger motor 5M is higher than the target rotational speed Ns ($Ni>Ns$), the amount of power to the heat exchanger motor 5M is decreased to decrease the output of the heat exchanger motor 5M by $\Delta m$ (steps S226 to S228).

If the rotational speed Ni of the heat exchanger motor 5M is lower than the target rotational speed Ns ($Ni<Ns$), the amount of power to the heat exchanger motor 5M is increased to increase the output of the heat exchanger motor 5M by $\Delta m$ (steps S229 and S230).

Note that output control with respect to the heat exchanger motor 5M (3M) is performed by the same type of control technique as that for phase control with respect to a known single-phase induction motor or applied voltage control with respect to a DC motor.

Figure 22:
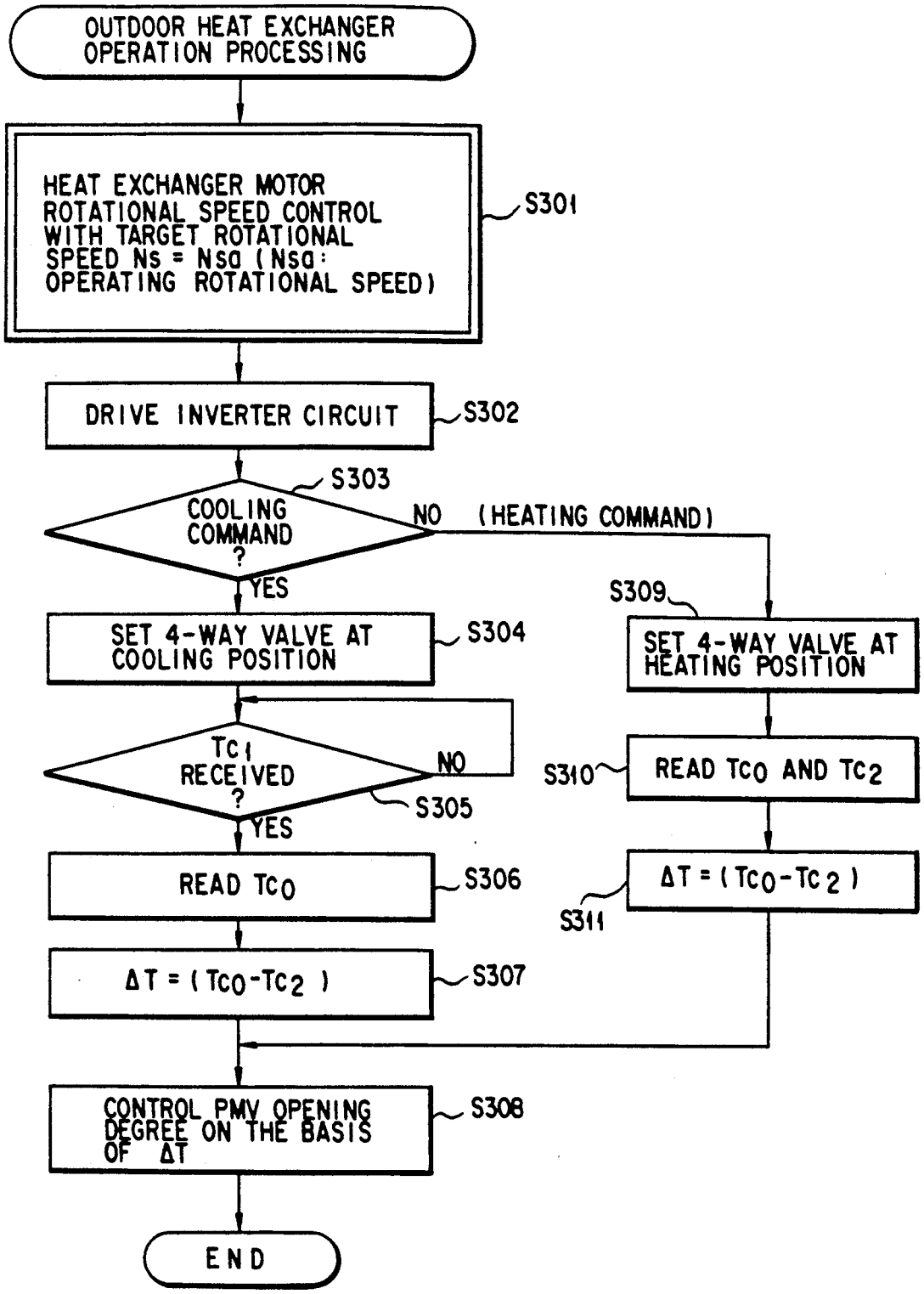
FIG. 22 is a flow chart for explaining an outdoor operation performed by the outdoor controller in FIG. 4.

(b) Outdoor heat exchange operation processing (see the flow chart in FIG. 22)

An operating rotational speed Nsa of the heat exchanger motor 3M is set as the target rotational speed Ns, and rotational speed control of the heat exchanger motor 3M is executed such that the motor rotational speed Nu detected by the motor rotational speed sensor 58 coincides with the target rotational speed Ns (step S301). This rotational speed control is the same as that performed by the indoor controller 21. In this control operation, reference symbol Ni in FIG. 21 is replaced with reference symbol Nu. Assume that reference symbol Ni is replaced with reference symbol Nu in FIG. 21 in subsequent rotational speed control of the outdoor rotary-type heat exchanger 3.

The operating frequency f designated in the indoor unit N described above is output as the operating frequency F.

The inverter circuit 35 is actually driven to supply the operating frequency F to the compressor motor 1M, thereby turning on the compressor 1 (step S302). With this operation, the compressor 1 exhibits the optimal capacity corresponding to the air-conditioning load.

When a cooling command is input from the indoor unit N, the 4-way valve 2 is set at a cooling position to form a cooling cycle. At the same time, the suction refrigerant temperature $Tc_0$, of the compressor 1, detected by the suction refrigerant temperature sensor 13 is read (steps S303 to S306).

When a certain period of time elapses after the operation is started, the temperature of the indoor rotary-type heat exchanger 5 is increased, the temperature (evaporator temperature) $Tc_1$ of the indoor rotary-type heat exchanger 5 is detected by the heat exchanger radiant temperature sensor 17.

The opening degree of the PMV 4 is controlled such that the difference between the suction refrigerant temperature $Tc_0$ and the evaporator temperature $Tc_1$, i.e., the degree of superheat of the refrigerant in the indoor rotary-type heat exchanger 5, is set to be a predetermined value (steps S307 and S308). By controlling the degree of superheat to the predetermined value, a stable operation of the cooling cycle is ensured.

If it is determined in step S303 that a heating command is input from the indoor unit N, the 4-way valve 2 is set at a heating position to form a heating cycle (step S309). At this time, the suction refrigerant temperature $Tc_0$, of the compressor 1, detected by the suction refrigerant temperature sensor 13 is read. At the same time, the temperature (evaporator temperature) $Tc_2$, of the outdoor rotary-type heat exchanger 3, detected by the heat exchanger radiant temperature sensor 11 is read (step S310).

The difference between the suction refrigerant temperature $Tc_0$ and the evaporator temperature $Tc_2$, i.e., the degree of superheat of the refrigerant in the outdoor rotary-type heat exchanger 3, is obtained (step S311), and the opening degree of the PMV 4 is controlled such that the degree of superheat is set to be a predetermined value (step S308). By controlling the degree of superheat to the predetermined value, a stable operation of the refrigeration cycle is ensured.

Figure 23:
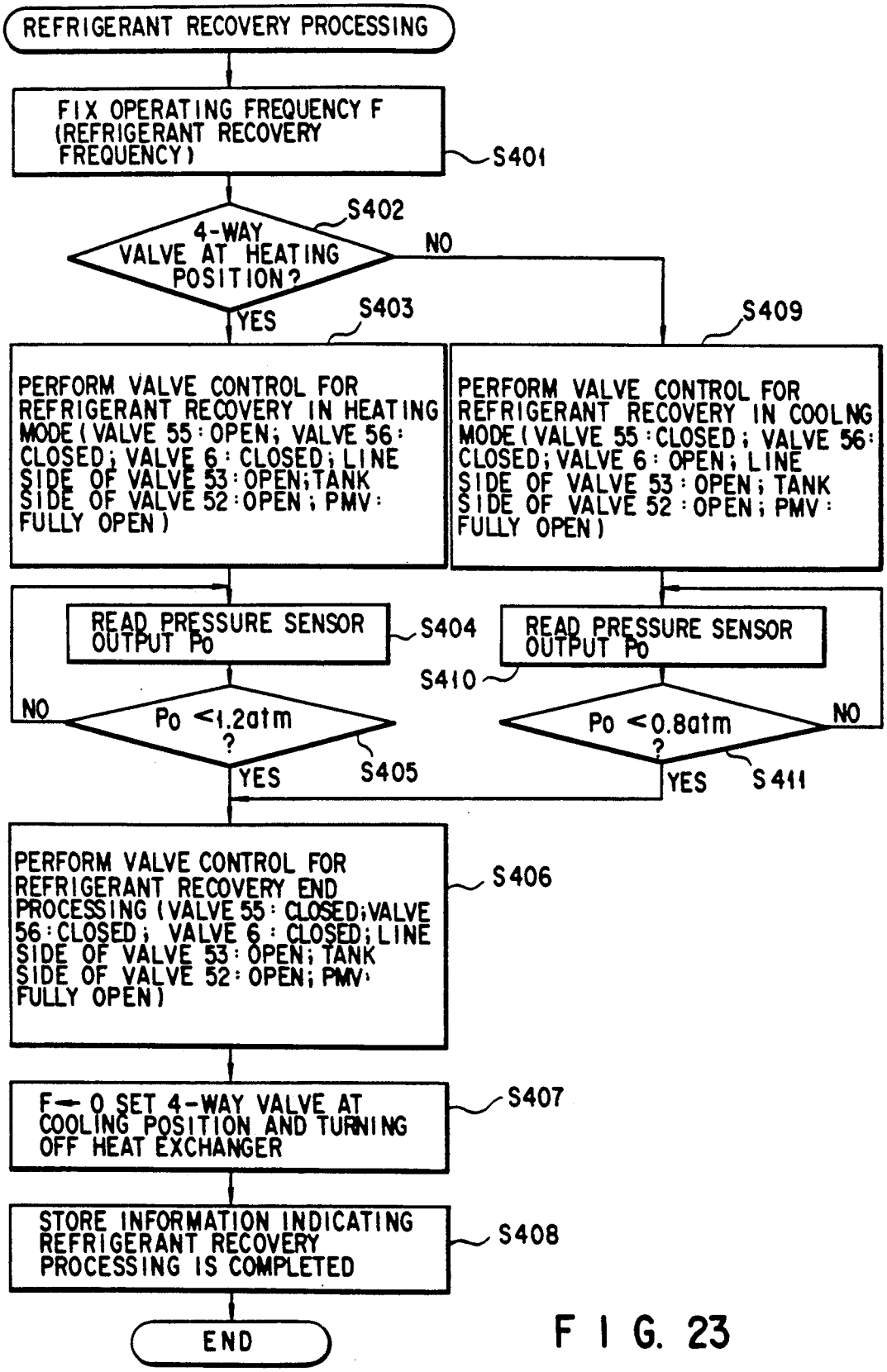
FIG. 23 is a flow chart for explaining refrigerant recovery processing in the refrigeration cycle in FIG. 1.

(c) Refrigerant recovery processing (see the flow chart in FIG. 23)

When a stop signal is input, refrigerant recovery processing is executed first.

The operating frequency F of the compressor 1 is fixed to a predetermined value for refrigerant recovery (step S401). The outdoor rotary-type heat exchanger 3 is kept rotated, and air from the outdoor rotary-type heat exchanger 3 flows through an air path (not shown) with the refrigerant being further liquefied In a cooling operation, the 2-way valve 55 is closed and the PMV 4 is fully opened while the position of the 4-way valve 2, the closed state of the 2-way valve 56, and the open state of the 2-way valve 6 remain the same. Thereafter, the tank side of the 3-way valve 52 is opened, and the line side of the 3-way valve 53 is opened (steps S402 and S409).

In this case, since the compressor 1 is kept operated, the refrigerant in the outdoor and indoor rotary-type heat exchangers 3 and 5 is recovered and is stored in the tank 54. The stored refrigerant is left in the tank 54 upon closing of the 3-way valve 53.

At this time, the detection pressure Po obtained by the pressure sensor 12 is fetched to be compared with a set value of 0.8 atm slightly lower than the atmospheric pressure (steps S410 and S411).

When the detection pressure Po decreases to the set value as the recovery proceeds, the 2-way valve 6 is closed, and the operation of the compressor 1 and the rotation of the outdoor rotary-type heat exchanger 3 are stopped (steps S406 and S407).

Since the 2-way valve 6 is closed, the refrigerant recovered to the compressor 1 side does not return to the indoor rotary-type heat exchanger 5. With this operation, the refrigerant recovery is completed. At the same time, the operation is stopped. Note that the information indicating that the refrigerant recovery is completed is stored in the internal memory (not shown) (step S408).

If it is determined in step S402 that the heating mode is set, the 2-way valve 6 is closed and the PMV 4 is fully opened while the position of the 4-way valve 2, the open state of the 2-way valve 55, and the closed state of the 2-way valve 56 remain the same. Thereafter, the tank side of the 3-way valve 52 is opened, and the line side of the 3-way valve 53 is opened (step S403).

In this case, since the compressor 1 is kept operated, the refrigerant in the outdoor and indoor rotary-type heat exchangers 3 and 5 is recovered to the compressor 1 side and is stored in the tank 54. The refrigerant stored in the tank 54 is left therein upon closing of the 3-way valve 53.

At this time, the detection pressure Po obtained by the pressure sensor 12 is fetched to be compared with a set value of 1.2 atm slightly higher than the detection pressure Po (steps S404 and S405).

When the detection pressure Po decreases to the set value as the recovery proceeds, the 2-way valve 55 is closed, and the operation of the compressor 1 and the rotation of the outdoor rotary-type heat exchanger 3 are stopped (steps S406 and S407).

Since the 2-way valve 55 is closed, the refrigerant recovered to the compressor 1 side does not return to the outdoor rotary-type heat exchanger 3. With this operation, the refrigerant recovery is completed. In addition, the 4-way valve 2 is set at a cooling position, and the operation is stopped. Note that the information indicating that the refrigerant recovery is completed is stored in the internal memory (not shown) (step S408).

A value of 0.8 atm is selected as a set detection pressure in the cooling mode; and a value of 1.2 atm, in the heating mode. Such setting is performed because the pressures in the rotary-type heat exchangers 3 and 5 are set to be equal to the atmospheric pressure during a non-operation period, and these values are set in consideration of the mounting position of the pressure sensor 12 and piping resistance based thereon.

When the operation is stopped, the refrigerant in the outdoor and indoor rotary-type heat exchangers 3 and 5 is recovered to the compressor 1 side and is stored in the tank 54 in this manner. With this operation, the refrigerant can be prevented from collecting in lower portions of the outdoor and indoor rotary-type heat exchangers 3 and 5 (lower portions set when they stop rotating) when the operation is stopped.

At the start of the next operation, therefore, no unbalanced vibration due to shifts in the centers of gravity of the outdoor and indoor rotary-type heat exchangers 3 and 5 occurs, and adverse influences on the service lives of the heat exchangers 3 and 5 can be eliminated.

In addition, since the internal pressures of the outdoor and indoor rotary-type heat exchangers 3 and 5 become the same as the atmospheric pressure, even if the seal structure of the indoor rotary-type heat exchanger 5 does not exhibit a sufficient sealing effect, leakage of the refrigerant can be prevented. This keeps the refrigerant circulation amount of the refrigeration cycle optimal, thus allowing a proper air conditioning operation and eliminating adverse influences on the service lives of the respective refrigeration cycle devices such as the compressor 1.

Furthermore, refrigerant recovery can be performed without changing the flowing direction of the refrigerant in both the cooling and heating modes and operating the 4-way valve 2 in one direction. Therefore, there is no need to take measures against noise such as noise made by a reversing operation of the 4-way valve 2 and noise made by a gas produced from the refrigerant. In addition, since a recovery operation is performed while the compressor 1 is kept operated, the time required for refrigerant recovery can be shortened.

Figure 24:
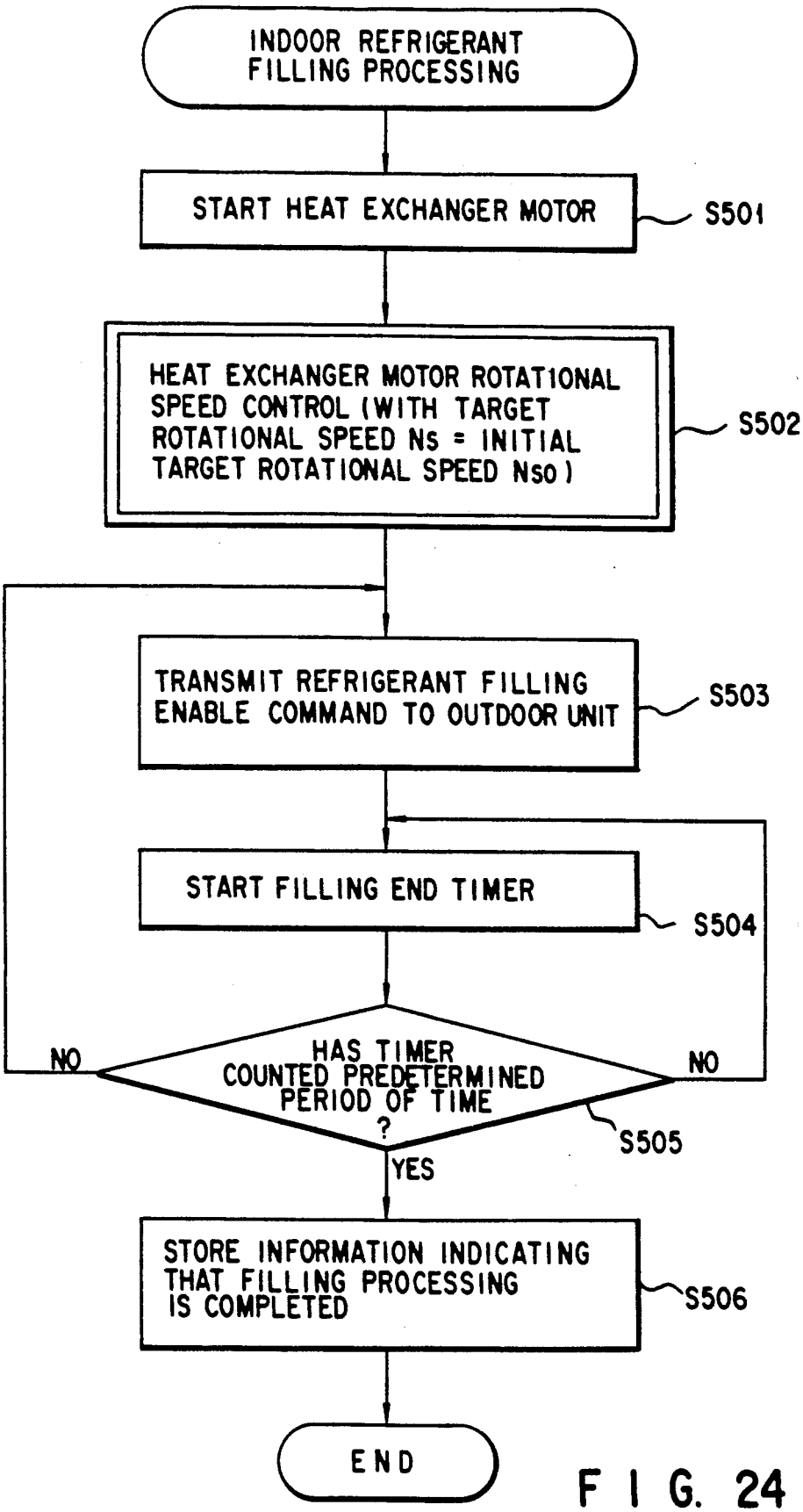
FIG. 24 is a flow chart for explaining indoor refrigerant filling processing performed by the indoor controller in FIG. 3.

(d) Indoor refrigerant filling processing (see the flow chart in FIG. 24)

When an operation command is input, refrigerant filling processing is executed prior to operation processing.

The heat exchanger motor 5 is started to start rotating the indoor rotary-type heat exchanger 5. At first, the relatively small initial rotational speed Nso is set as the target rotational speed Ns (steps S501 and S502). Heat exchanger motor rotational speed control with respect to the heat exchanger motor 5M is executed such that the motor rotational speed Ni detected by the motor rotational speed sensor 18 coincides with the target rotational speed Ns (step S502). This heat exchanger motor rotational speed control is the same as that in FIG. 21.

At the same time, a refrigerant filling enable command from the refrigerant filling enable command section **21*b* is supplied to the outdoor unit S, and the filling end timer section 21*c* is started (step S504**).

The filling end timer section **21*c* is designed to count one minute as the time required for filling processing. When the section 21*c* counts up one minute, the information indicating that filling processing is completed is stored in the internal memory (not shown) (steps S505 and S506**).

Figure 25:
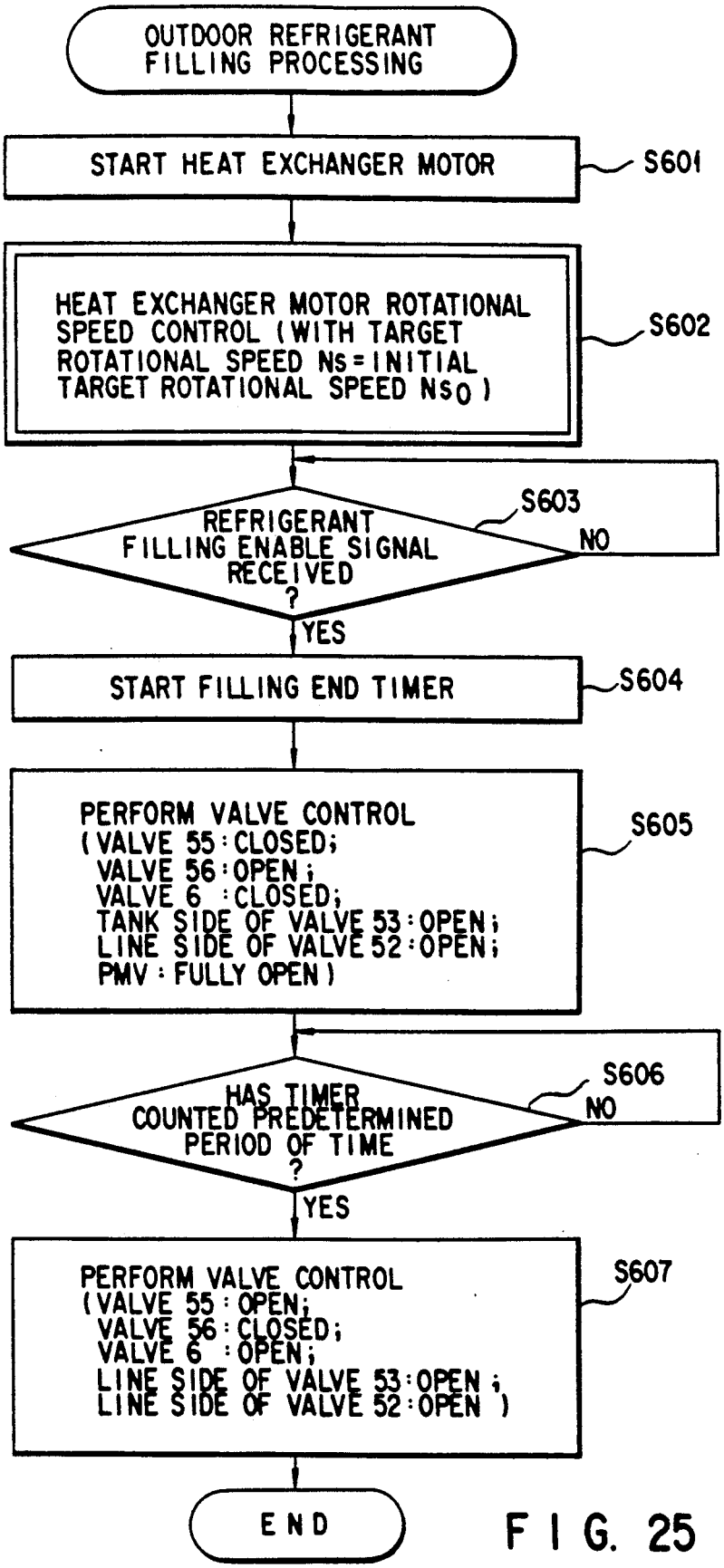
FIG. 25 is a flow chart for explaining outdoor refrigerant filling processing performed by the outdoor controller in FIG. 4.

(e) Outdoor refrigerant filling processing (see the flow chart in FIG. 25)

When an operation command is input, refrigerant filling processing is executed prior to operation processing.

The heat exchanger motor 3M is started to start rotating the outdoor rotary-type heat exchanger 3. At first, the relatively small initial rotational speed Nso is set as the target rotational speed Ns (steps S601 and S602). Heat exchanger motor rotational speed control with respect to the heat exchanger motor 3M is executed such that the motor rotational speed Nu detected by the motor rotational speed sensor 58 coincides with the target rotational speed Ns (step S602). This heat exchanger motor rotational speed control is the same as that in FIG. 21 (however, reference symbol Ni in FIG. 21 is replaced with reference numeral Nu).

When a refrigerant filling enable command is input from the indoor unit N, the filling end timer section 24g is started, and the next valve control is performed (steps S603 and S604).

The line side of the 3-way valve 52 and the tank side of the 3-way valve 53 are opened. The 4-way valve 2 is held at a cooling position regardless of whether the heating or cooling mode is set.

The 2-way valve 55 is closed, and the 2-way valve 56 is opened. In addition, the PMV 4 is fully open. The 2-way valve 6 is kept closed (step S605).

The refrigerant in the tank 54, therefore, flows into the outdoor rotary-type heat exchanger 3 through the 4-way valve 2, the 2-way valve 56, and the capillary tube 57. Thereafter, the refrigerant also flows into the indoor rotary-type heat exchanger 5 through the fully open PMV 4.

At this time, the capillary tube 57 exhibits resistance to the refrigerant to limit the amount of refrigerant flowing into the outdoor rotary-type heat exchanger 3. With this operation, the refrigerant is filled little by little.

The filling end timer section 24g counts one minute as the time required for filling processing, similar to the operation on the indoor side.

When the filling end timer section 24g counts up one minute, the line sides of the 3-way valves 52 and 53 are opened, and the 2-way valve 55 is opened. In addition, the 2-way valve 56 is closed, and the 2-way valve 6 is opened (steps S606 and S607). With this operation, the refrigerant filling processing is completed, and normal operation processing (e.g., an ON/OFF operation of the compressor 1) is started.

Figure 26:
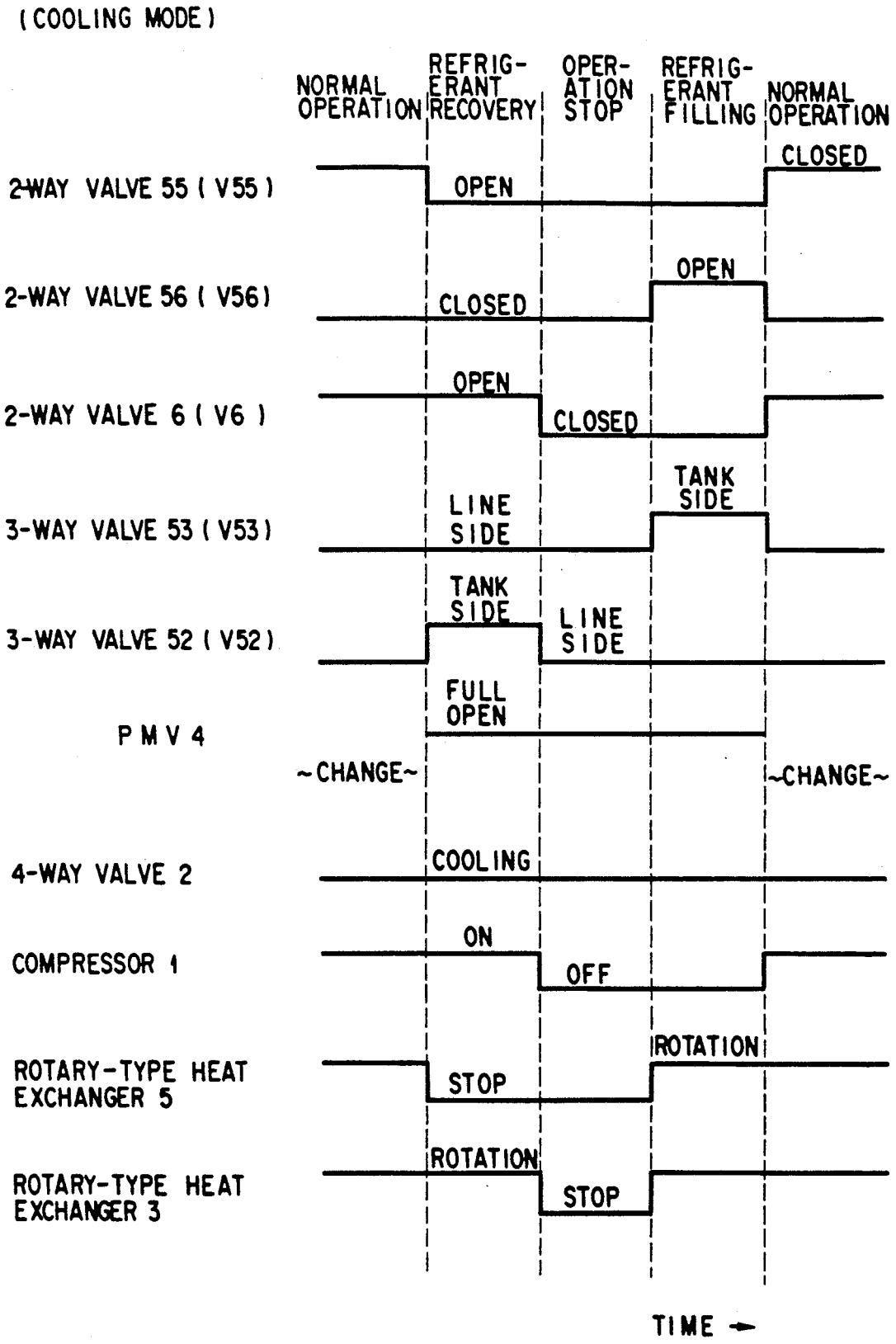
FIG. 26 is a timing chart collectively showing the actions of the respective devices in the refrigeration cycle in FIG. 1 in the cooling mode.
Figure 27:
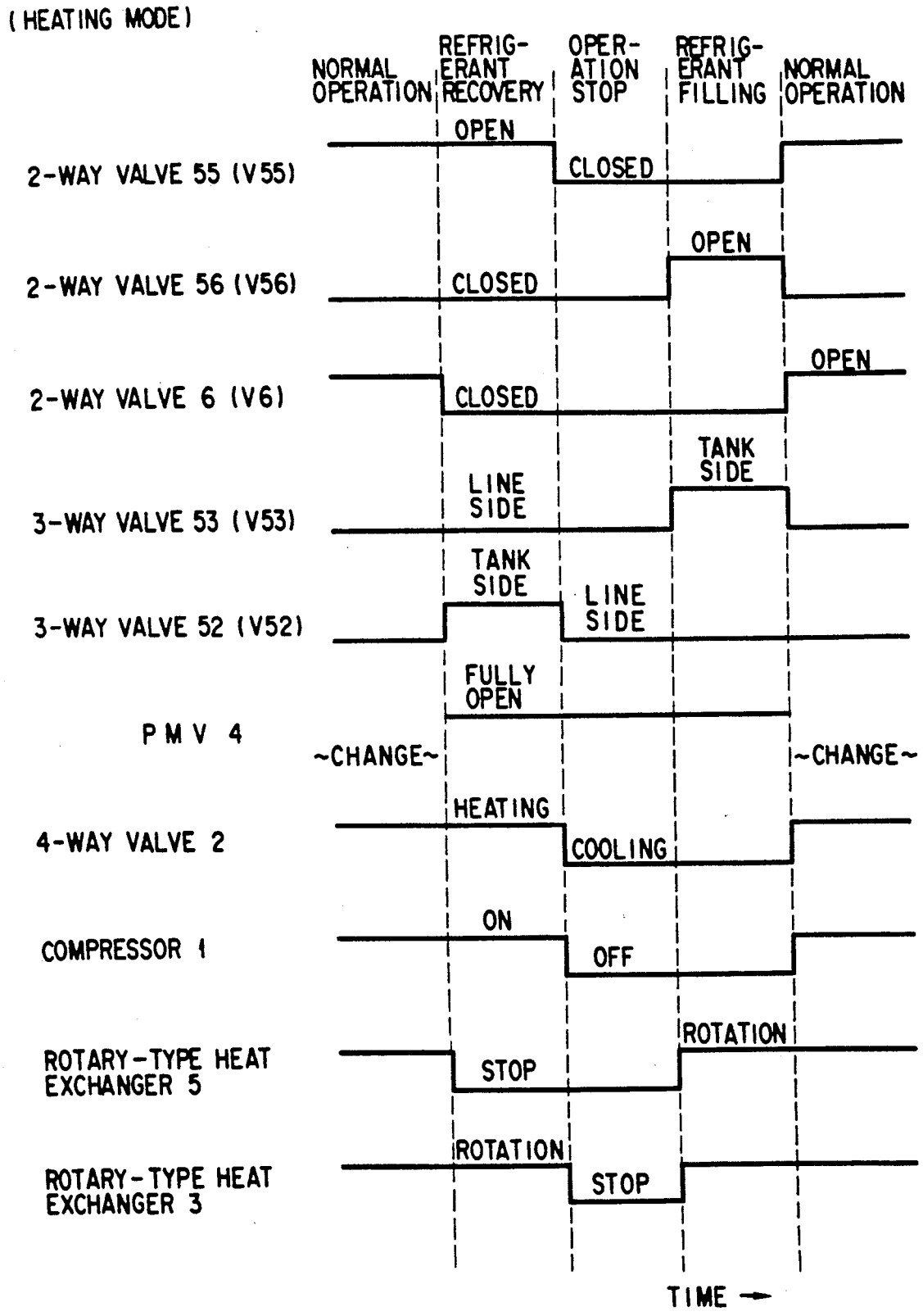
FIG. 27 is a timing chart collectively showing the actions of the respective devices in the refrigeration cycle in the heating mode.

FIGS. 26 and 27 briefly show the actions of the respective devices in the operation processing, the refrigerant recovery processing, and the refrigerant filling processing described above in the cooling mode and the heating mode, respectively.

As described above, while the outdoor and indoor rotary-type heat exchanger 3 and 5 are rotated at the initial rotational speed Nso, the refrigerant is gradually supplied to the heat exchangers 3 and 5. With this operation, the refrigerant can be uniformly filled, thus preventing unbalanced vibration of the rotary-type heat exchangers 3 and 5.

As described above, according to the embodiment, since the indoor rotary-type heat exchanger 5 of a lateral flow fan type is used, a reduction in installation space can be achieved, as compared with the case wherein a so-called finned tube type heat exchanger is used. In addition, heat exchange can be effectively performed. Furthermore, according to the embodiment, since the outdoor unit S requires no special fan, the air conditioner is advantageous in terms of cost.

As shown in FIG. 7, drain waterdrops produced upon heat exchange between air in the room to be air-conditioned and the refrigerant are attached to the blades 118 of the indoor rotary-type heat exchanger 5, and move to the peripheral end upon rotation of the heat exchanger 5. The brush unit 107 scrapes the drain waterdrops from the blades 118 and guides them to the drain vessel portion 109. In this manner, the brush unit 107 can remove the drain waterdrops without increasing a pressure loss with respect to the indoor rotary-type heat exchanger 5, and prevents noise made by the drain waterdrops which fall on the drain vessel portion 109.

A water absorptive cloth (not shown) may be stretched along the front surface of the air path forming plate 120. In this case, even if residual drain waterdrops, which the brush unit 107 cannot scrape, scatter around, the water absorptive cloth absorbs the drain waterdrops, thus completely preventing the waterdrops from being discharged from the outlet port 102.

In either a heating or cooling operation, the refrigerant is guided into the flow divider 114 before it flows into the indoor rotary-type heat exchanger 5, and is temporarily supplied from the indoor rotary-type heat exchanger 5 to the flow divider 114 to be guided in a predetermined direction.

More specifically, as shown in FIG. 13, in a cooling operation, the refrigerant flows from the PMV 4 and is guided to the center pipe 113 through the refrigerant pipe Pa and the boss portion 125a integrally formed on the housing 125. The refrigerant is discharged from the opening in the other end of the center pipe 113 into the chamber A 112a and fills the chamber. The refrigerant is then guided along the plurality of partition chambers 122, (see FIG. 11) in the blades 118, which are open to the end plate 110a.

The refrigerant flows in a direction reverse to the guiding direction in the center pipe 113, and is guided into the chamber B 112b while effectively undergoing heat exchange. In this case, the refrigerant is directly discharged into the housing 125 through the plurality of flow paths 127 formed between the center pipe 113 and the guide pipe 126, thus filling the housing 125.

The housing 125 is mechanically sealed by the stationary seal plate 127a and the rotating seal plate 127b, which are fixed to each other in tight contact, so as to be airtight with respect to outer air. The refrigerant filling the housing 125 flows from the flow divider 114 and is guided to the 4-way valve 2 through the refrigerant pipe Pb.

In the heating mode, the refrigerant is guided in directions completely reverse to those described above.

Since the indoor rotary-type heat exchanger 5 has such an arrangement, and the flow divider 114 is coupled thereto, smooth circulation of the refrigerant can be performed, and a more effective heat exchange function can be obtained. In addition, a reduction in the size of an apparatus can be realized.

In either a cooling or heating operation, the vertical louvers 19 arranged at the outlet port 102 are respectively pivoted/driven to optimal angles by the driving motors 19M respectively coupled to the louvers 19, and they are held at the respective positions.

With this operation, the outlet air velocity and direction can be reliably controlled to coincide with set values, thus allowing finer, comfortable air conditioning.

Since a lateral flow fan type heat exchanger is used as the outdoor rotary-type heat exchanger 3, similar to the indoor rotary-type heat exchanger 5, a reduction in installation space can be achieved, and effective heat exchange can be performed, as compared with the case wherein a so-called finned tube type heat exchanger is used. Since no special fan is required, the air conditioner of the embodiment is advantageous in terms of cost.

In addition, as shown in FIGS. 5A and 5B, the outdoor unit S includes the integral pipe unit 144 as one control block incorporating the following components of the heat pump refrigeration cycle: the 4-way valve 2, the PMV 4, one pair of connection valves, and the refrigerant pipe portions causing the respective valves to communicate with each other. Since one component includes a control section, operation checks can be performed in units of components. According to this arrangement, there is no need to arrange pipes between the respective valves in the outdoor unit S, and hence a reduction in space can be achieved. In addition, no brazing operation for connecting pipes in a piping operation is required. Therefore, the number of places where gas leak may occur is greatly decreased, and automatization of unit assembly is facilitated.

Although the outdoor rotary-type heat exchanger 3 is designed to incorporate the heat exchanger motor 3M, if there is a sufficient space in the indoor rotary-type heat exchanger 5, this structure ma be applied to the heat exchanger 5.

As has been described above, according to the present invention, when an operation is stopped, the refrigerant in the rotary-type heat exchangers respectively used for the outdoor and indoor units of the refrigeration cycle is recovered. At the start of an operation, while rotation of each rotary-type heat exchanger is started, the refrigerant is caused to gradually flow from the tank to be filled in each heat exchanger. Therefore, there is provided a highly reliable air conditioner which can eliminate unbalanced vibration of each rotary-type heat exchanger, and can prevent leakage of the refrigerant from each rotary-type heat exchanger.

Additional embodiments of the present invention will be apparent to those skilled in the art from consideration of the specification and practice of the present invention disclosed herein. It is intended that the specification and examples be considered as exemplary only, with the true scope of the present invention being indicated by the following claims.

What is claimed is:

1. An air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

a refrigerant tank selectively set in a connected state and a non-connected state with respect to a refrigerant discharge side of said compressor;

pressure detecting means for detecting at least a pressure at one side of each of said indoor and outdoor rotary-type heat exchangers;

first control means for setting said refrigerant tank in a non-connected state when a normal operation of said air conditioner is to be started, and controlling a capacity of said compressor, a rotational speed of said outdoor rotary-type heat exchanger, a rotational speed of said indoor rotary-type heat exchanger, and an opening degree of said motor-operated expansion valve in accordance with at least an air-conditioning load, thereby performing the normal operation of said air conditioner;

second control means for causing said compressor to keep operating at a predetermined capacity until a detection pressure from said pressure detecting means coincides with a set pressure value, when said air conditioner is to be stopped, and setting said refrigerant tank in a connected state while controlling said motor-operated expansion valve to a predetermined opening degree, thereby recovering the refrigerant in said refrigerant tank; and third control means for rotating said outdoor and indoor rotary-type heat exchangers at a predetermined speed when said air conditioner is to be started, and setting said refrigerant tank in a connected state while controlling said motor-operated expansion valve to a predetermined opening degree, thereby filling the refrigerant, recovered in said refrigerant tank by said second control means, in said outdoor and indoor rotary-type heat exchangers.

2. An air conditioner according to claim 1, wherein said outdoor rotary-type heat exchanger includes a heat exchanger motor integrally coupled to a side end portion thereof.

3. An air conditioner according to claim 1, wherein said second control means includes means for setting the set pressure value to be a value allowing internal pressures of said outdoor and indoor rotary-type heat exchangers to be equal to an atmospheric pressure.

4. An air conditioner according to claim 1, wherein said second control means includes means for keeping said outdoor rotary-type heat exchanger rotated at a predetermined speed until the detection pressure from said pressure detecting means coincides with the set pressure value.

5. An air conditioner according to claim 1, wherein said refrigeration cycle includes first and second 2-way valves connected between the refrigerant discharge side and a refrigerant suction side of said compressor and said outdoor and indoor rotary-type heat exchangers, said first and second 2-way valves being selectively opened/closed to prevent the refrigerant recovered by said second control means from flowing backward.

6. An air conditioner according to claim 1, wherein said refrigeration cycle includes refrigerant inflow amount control mean selectively connected between the refrigerant discharge side of said compressor and said outdoor rotary-type heat exchanger, said refrigerant inflow amount control means limiting an inflow amount of the refrigerant filled by said third control means.

7. An air conditioner according to claim 3, wherein the set pressure value is set to be about 0.8 atm when said refrigeration cycle constitutes a cooling cycle, and is set to be about 1.2 atm when said refrigeration cycle constitutes a heating cycle.

8. An air conditioner according to claim 1, wherein said third control means includes means for causing said refrigeration cycle to constitute a cooling cycle regardless of whether a cooling operation or a heating operation is performed, when the refrigerant is to be filled.

9. An air conditioner according to claim 1, wherein said air conditioner further comprises noncontact temperature detecting means for detecting a temperature of said indoor rotary-type heat exchanger in a noncontact manner, and said first control means includes means for calculating a degree of superheat of the refrigerant in said indoor rotary-type heat exchanger in accordance with a detection output from said noncontact temperature detecting means, and controlling said motor-operated expansion valve such that the calculated degree of superheat coincides with a predetermined value.

10. An air conditioner according to claim 1, wherein at least one of said outdoor and indoor rotary-type heat exchangers includes a flow divider for rotatably supporting one end of said rotary-type heat exchanger, said flow divider comprising:

a housing having a penetrated portion formed in one end thereof, and a boss portion formed on the other end thereof, the penetrated portion allowing a center pipe, in which the refrigerant is guided, to penetrate therethrough, and the boss portion rotatably supporting a penetrating end portion of said center pipe;

a guide pipe which penetrates through the penetrated portion of said housing and is fitted on said center pipe to constitute a flow path for the refrigerant;

a mechanical seal having a stationary seal plate and a rotatable seal plate which are fitted on a circumferential portion of said guide pipe in tight contact therewith inside said housing, thereby forming an air tight structure with respect to outer air;

a first refrigerant pipe connected to the boss portion of said housing to communicate with a protruding end portion of said center pipe; and a second refrigerant pipe connected to a predetermined portion of said housing to communicate with the refrigerant flow path formed by said guide pipe.

11. An air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

a refrigerant tank selectively set in a connected state and a non-connected state with respect to a refrigerant discharge side of said compressor;

pressure detecting means for detecting at least a pressure at one side of each of said indoor and outdoor rotary-type heat exchangers;

first control means for setting said refrigerant tank in a non-connected state when a normal operation of said air conditioner is to be started, and controlling a capacity of said compressor, a rotational speed of said outdoor rotary-type heat exchanger, a rotational speed of said indoor rotary-type heat exchanger, and an opening degree of said motor-operated expansion valve in accordance with an air-conditioning load, thereby performing the normal operation of said air conditioner; and second control means for causing said compressor to keep operating at a predetermined capacity until a detection pressure from said pressure detecting means coincides with a set pressure value, when said air conditioner is to be stopped, and setting said refrigerant tank in a connected state while controlling said motor-operated expansion valve to a predetermined opening degree, thereby recovering the refrigerant in said refrigerant tank.

12. An air conditioner according to claim 11, wherein said outdoor rotary-type heat exchanger includes a heat exchanger motor integrally coupled to a side end portion thereof.

13. An air conditioner according to claim 11, wherein said second control means includes means for setting the set pressure value to be a value allowing internal pressures of said outdoor and indoor rotary-type heat exchangers to be equal to an atmospheric pressure.

14. An air conditioner according to claim 11, wherein said second control means includes means for keeping said outdoor rotary-type heat exchanger rotated at a predetermined speed until the detection pressure from said pressure detecting means coincides with the set pressure value.

15. An air conditioner according to claim 11, wherein said refrigeration cycle includes first and second 2-way valves connected between the refrigerant discharge side and a refrigerant suction side of said compressor and said outdoor and indoor rotary-type heat exchangers, said first and second 2-way valves being selectively opened/closed to prevent the refrigerant recovered by said second control means from flowing backward.

16. An air conditioner according to claim 13, wherein the set pressure value is set to be about 0.8 atm when said refrigeration cycle constitutes a cooling cycle, and is set to be about 1.2 atm when said refrigeration cycle constitutes a heating cycle.

17. An air conditioner according to claim 11, wherein said apparatus further comprises noncontact temperature detecting means for detecting a temperature of said indoor rotary-type heat exchanger in a noncontact manner, and said first control means includes means for calculating a degree of superheat of the refrigerant in said indoor rotary-type heat exchanger in accordance with a detection output from said noncontact temperature detecting means, and controlling said motor-operated expansion valve such that the calculated degree of superheat coincides with a predetermined value.

18. An air conditioner according to claim 11, wherein at least one of said outdoor and indoor rotary-type heat exchangers includes a flow divider for rotatably supporting one end of said rotary-type heat exchanger, said flow divider comprising:

a housing having a penetrated portion formed in one end thereof, and a boss portion formed on the other end thereof, the penetrated portion allowing a center pipe, in which the refrigerant is guided, to penetrate therethrough, and the boss portion rotatably supporting a penetrating end portion of said center pipe;

a guide pipe which penetrates through the penetrated portion of said housing and is fitted on said center pipe to constitute a flow path for the refrigerant;

a mechanical seal having a stationary seal plate and a rotatable seal plate which are fitted on a circumferential portion of said guide pipe in tight contact therewith inside said housing, thereby forming an air tight structure with respect to outer air;

a first refrigerant pipe connected to the boss portion of said housing to communicate with a protruding end portion of said center pipe; and a second refrigerant pipe connected to a predetermined portion of said housing to communicate with the refrigerant flow path formed by said guide pipe.

19. An air conditioner comprising:

a refrigeration cycle having a compressor, an outdoor rotary-type heat exchanger, a motor-operated expansion valve, and an indoor rotary-type heat exchanger which are sequentially connected to each other to circulate a refrigerant;

first control means for controlling a capacity of said compressor in accordance with an air-conditioning load;

second control means for controlling a rotational speed of said outdoor rotary-type heat exchanger;

third control means for controlling a rotational speed of said indoor rotary-type heat exchanger; and fourth control means for controlling an opening degree of said motor-operated expansion valve in accordance with a state of said refrigeration cycle.

20. An air conditioner according to claim 19, wherein said apparatus further comprises noncontact temperature detecting means for detecting a temperature of said indoor rotary-type heat exchanger in a noncontact manner, and said fourth control means includes means for calculating a degree of superheat of the refrigerant in said indoor rotary-type heat exchanger in accordance with a detection output from said noncontact temperature detecting means, and controlling said motor-operated expansion valve such that the calculated degree of superheat coincides with a predetermined value.

* * * * *